US009259937B2

(12) United States Patent
Taniguchi et al.

(10) Patent No.: US 9,259,937 B2
(45) Date of Patent: Feb. 16, 2016

(54) PRINTING APPARATUS

(71) Applicant: CANON KABUSHIKI KAISHA, Tokyo (JP)

(72) Inventors: Hisashi Taniguchi, Yokohama (JP); Tetsuyo Ohashi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/627,225

(22) Filed: Feb. 20, 2015

(65) Prior Publication Data

US 2015/0239251 A1 Aug. 27, 2015

(30) Foreign Application Priority Data

Feb. 25, 2014 (JP) ..... 2014-034488

(51) Int. Cl.
*B41J 29/13* (2006.01)
*B41J 29/393* (2006.01)
*B41J 2/175* (2006.01)

(52) U.S. Cl.
CPC ..... *B41J 2/1752* (2013.01)

(58) Field of Classification Search
CPC .... B41J 2/1752; B41J 2/1754; B41J 2/17509; B41J 2/17513; B41J 2/17543; B41J 2/17566; B41J 2/17593
USPC ..... 347/2, 3, 7, 19, 49, 85, 86, 108
See application file for complete search history.

(56) References Cited

U.S. PATENT DOCUMENTS

| | | | | |
|---|---|---|---|---|
| 5,428,378 | A * | 6/1995 | Murata et al. | 347/19 |
| 5,512,926 | A | 4/1996 | Uchikata et al. | |
| 5,917,518 | A | 6/1999 | Ohashi et al. | |
| 6,012,810 | A | 1/2000 | Ohashi | |
| 6,022,091 | A | 2/2000 | Uchikata et al. | |
| 6,050,673 | A | 4/2000 | Wada et al. | |
| 6,065,831 | A * | 5/2000 | Kawaura et al. | 347/108 |
| 6,796,648 | B2 | 9/2004 | Ohashi | |
| 7,114,867 | B2 | 10/2006 | Ohashi et al. | |
| 7,187,901 | B2 | 3/2007 | Ohashi | |
| 7,278,721 | B2 * | 10/2007 | Shimizu et al. | 347/86 |
| 7,334,861 | B2 * | 2/2008 | Ha | 347/19 |
| 7,441,861 | B2 | 10/2008 | Fujibayashi | |
| 7,510,257 | B2 * | 3/2009 | Jung et al. | 347/19 |
| 8,146,529 | B2 | 4/2012 | Hakamata et al. | |
| 8,220,411 | B2 | 7/2012 | Yoshino et al. | |
| 8,789,491 | B2 | 7/2014 | Nagahara et al. | |

FOREIGN PATENT DOCUMENTS

| | | |
|---|---|---|
| JP | 2007-001167 | 11/2007 |
| JP | 4585927 A | 11/2010 |

* cited by examiner

*Primary Examiner* — Anh T. N. Vo
(74) *Attorney, Agent, or Firm* — Fitzpatrick, Cella, Harper & Scinto

(57) ABSTRACT

A printing apparatus that facilitates an operation of replacing a printing-agent housing container is provided. In the printing apparatus, when a cover is closed, a LED and a light receiving section can acquire information on whether or not an ink tank is mounted on a carriage. Furthermore, when the cover is opened, the light receiving section can move in a retracting direction from an opening.

9 Claims, 17 Drawing Sheets

| CONDITION NUMBER | PRESENCE OR ABSENCE OF DETECTION OF LIGHT EMISSION | PRESENCE OR ABSENCE OF LIGHT EMISSION FROM INK TANK | WHETHER OR NOT INK TANK IS LOCATED AT PREDETERMINED DETECTION POSITION | COVER OPEN OR CLOSE DETERMINATION |
|---|---|---|---|---|
| CONDITION 1 | O | O | O | CLOSE |
| CONDITION 2 | O | O | × | OPEN |
| CONDITION 3 | O | × | NO DEPENDS | OPEN |
| CONDITION 4 | × | O | O | OPEN |
| CONDITION 5 | × | O | × | CLOSE |
| CONDITION 6 | × | × | NO DEPENDS | CLOSE |

FIG.8

PRINTING APPARATUS

BACKGROUND OF THE INVENTION

1. Field of the Invention

The present invention relates to a printing apparatus equipped with a replaceable printing-agent housing container.

2. Description of the Related Art

Printing apparatuses may be based on a printing system such as an inkjet system or a laser beam system. These printing apparatuses may be equipped with printing-agent housing containers that house printing agent such as ink or toner and perform printing using the printing agents housed in the printing-agent housing containers. In such a printing apparatus, when the printing agent housed inside the mounted printing-agent housing container is consumed and exhausted, the printing agent is replaced with a new one.

Furthermore, the printing apparatus may be configured such that the mounted printing-agent housing containers are movable. Japanese Patent No. 4585927 discloses an ink jet printing apparatus in which a carriage and an ink tank are movable along the thickness direction of print media.

In the ink jet printing apparatus disclosed in Japanese Patent No. 4585927, the heights of the ink tank and a print head from a print medium are varied in accordance with the thickness of the print medium. When plain paper is printed, the carriage, the ink tank, and the print head are disposed at relatively low positions. When an optical disc is printed, the carriage, the ink tank, and the print head are disposed at relatively high positions.

SUMMARY OF THE INVENTION

According to the present invention, a printing apparatus comprising: a mounting unit on which a printing-agent housing container and printing unit are able to be mounted, the printing-agent housing container internally containing a printing agent, the printing unit performing printing using the printing agent housed in the printing-agent housing container, the mounting unit enabling a scan in a main scan direction; a detection section configured to acquire information on whether or not the printing-agent housing container is mounted on the mounting unit; a housing configured to internally store the mounting unit with the printing-agent housing container and the printing unit mounted thereon, the housing comprising an opening through which the printing-agent housing container mounted on the mounting unit is able to be opened to an exterior; and a cover configured to be able to cover the opening, wherein, when the cover is closed, the detection section is able to acquire information on whether or not the printing-agent housing container is mounted on the mounting unit, and when the cover is opened, the detection section is able to move in a retracting direction from the opening.

Further features of the present invention will become apparent from the following description of exemplary embodiments (with reference to the attached drawings).

BRIEF DESCRIPTION OF THE DRAWINGS

FIG. 8 is a table showing each of output result regarding a judgment with respect to opening and closing state of a cover in the printing apparatus according to a second embodiment of the present invention;

DESCRIPTION OF THE EMBODIMENTS

Figure 1:
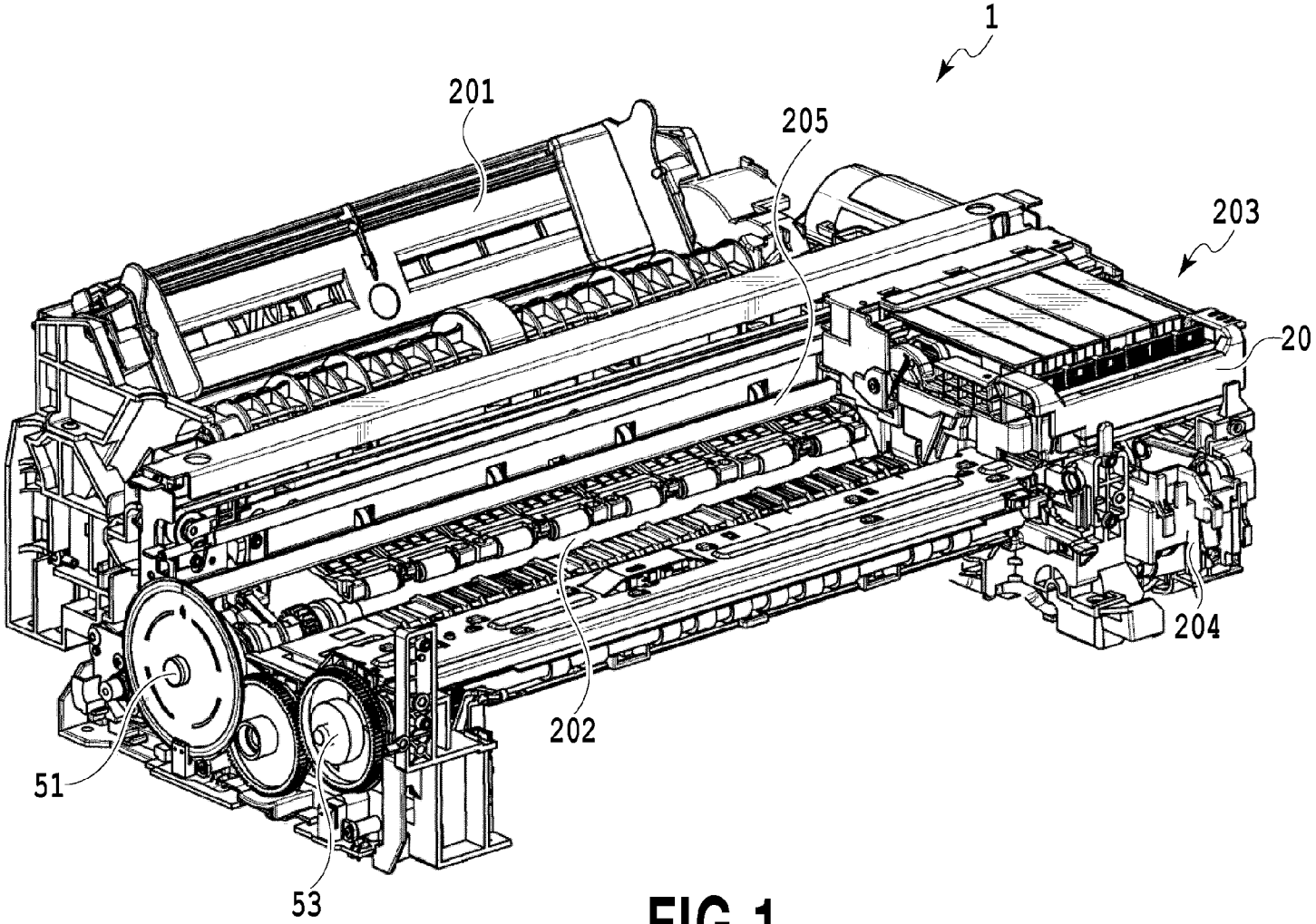
FIG. 1 is a perspective view showing an internal configuration of a printing apparatus according to a first embodiment of the present invention.

In the ink jet printing apparatus disclosed in Japanese Patent No. 4585927, the carriage, the ink tank, and the print head are only movable in the thickness direction of the print medium. Thus, when the ink inside the ink tank is exhausted and replaced with a new one, a space needed for replacement of the ink tank is insufficient, possibly leading to a complicated replacement operation.

In view of the above circumstances, it is an object of the present invention to provide a printing apparatus that facilitates an operation of replacing a printing-agent housing container.

First Embodiment

A printing apparatus according to a first embodiment of the present invention will be described below with reference to the drawings. Throughout the drawings, the same or corresponding portions are denoted by the same reference numerals.

FIG. 1 shows a perspective view of an internal configuration of a printing apparatus 1 according to the first embodiment of the present invention. The printing apparatus 1 is provided with a supply section 201 allowing a print medium to be supplied, a conveying section 202 that conveys the supplied print medium, and a printing section 203 that applies ink (printing agent) to the print medium to form an image. Moreover, a recovery section 204 is provided to perform maintenance such as cleaning in order to maintain the performance of the printing section 203.

The printing section 203 includes a print head 200 that ejects ink, an ink tank 10 in which ink is stored, and a carriage 20 with the print head 200 mounted thereon. The print head (printing unit) 200 and the ink tank (printing-agent housing container) 10 can be mounted on the carriage 20. The carriage 20 can perform scanning (moving) along a main scan direction. When printing is performed, the print head 200 and the ink tank 10 are mounted on the carriage 20. The print head 200 performs printing by ejecting the ink housed in the ink tank 10.

Each of the print media stacked in the supply section 201 is separated from the other print media and fed into the conveying section 202. The carriage 20 is guided and supported so as to be able to reciprocate in the main scan direction by means of a guide rail 205. The carriage 20 is reciprocated via a timing belt by the driving force of a carriage motor. The print head 200 has a plurality of ejection ports arranged therein in rows and is a print head configured as an ink jet head type that ejects ink from the ejection port. The print head 200 is provided with printing elements such as heating elements or piezo elements which correspond to the respective ejection ports and which apply energy to ink to eject the ink.

The conveying section 202 has a conveying roller 51, a discharge roller 53, and a sheet feeding motor that rotationally drives the conveying roller 51 and the discharge roller 53. The conveying section 202 thus conveys the print medium in a sub-scan direction orthogonal to the main scan direction on a step-by-step basis. A sheet printed by the printing section 203 is nipped between a spur and the discharge roller 53, which rotates in conjunction with the conveying roller 51. The sheet is then discharged into a discharge tray.

The printing apparatus 1 according to the present embodiment adopts what is called a serial scan system. Printing is performed by ejecting ink from the print head 200 in synchronization with the reciprocation (main scan) of the carriage 20 in the printing section 203. The printing apparatus 1 forms an image all over the print medium by alternately repeating the printing operation and the conveying operation that the print medium is conveyed per predetermined pitch on a step-by-step basis (sub-scan).

The recovery section 204 maintains and recovers the ejection of ink through the ejection ports in and to a normal state by eliminating, for example, blocking of the ejection ports in the print head caused by an increased viscosity of ink around the ejection ports. The recovery section 204 includes a pump that generates a pressure allowing ink to be sucked or ejected through the ejection ports, a cap that covers the ejection ports to prevent drying, and a wiper that wipes and cleans surfaces of the ejection ports.

The printing apparatus 1 has control unit (not shown in the drawings) for executing control processing, data processing, and the like. In the present embodiment, a CPU functions as the control unit.

Figure 2:
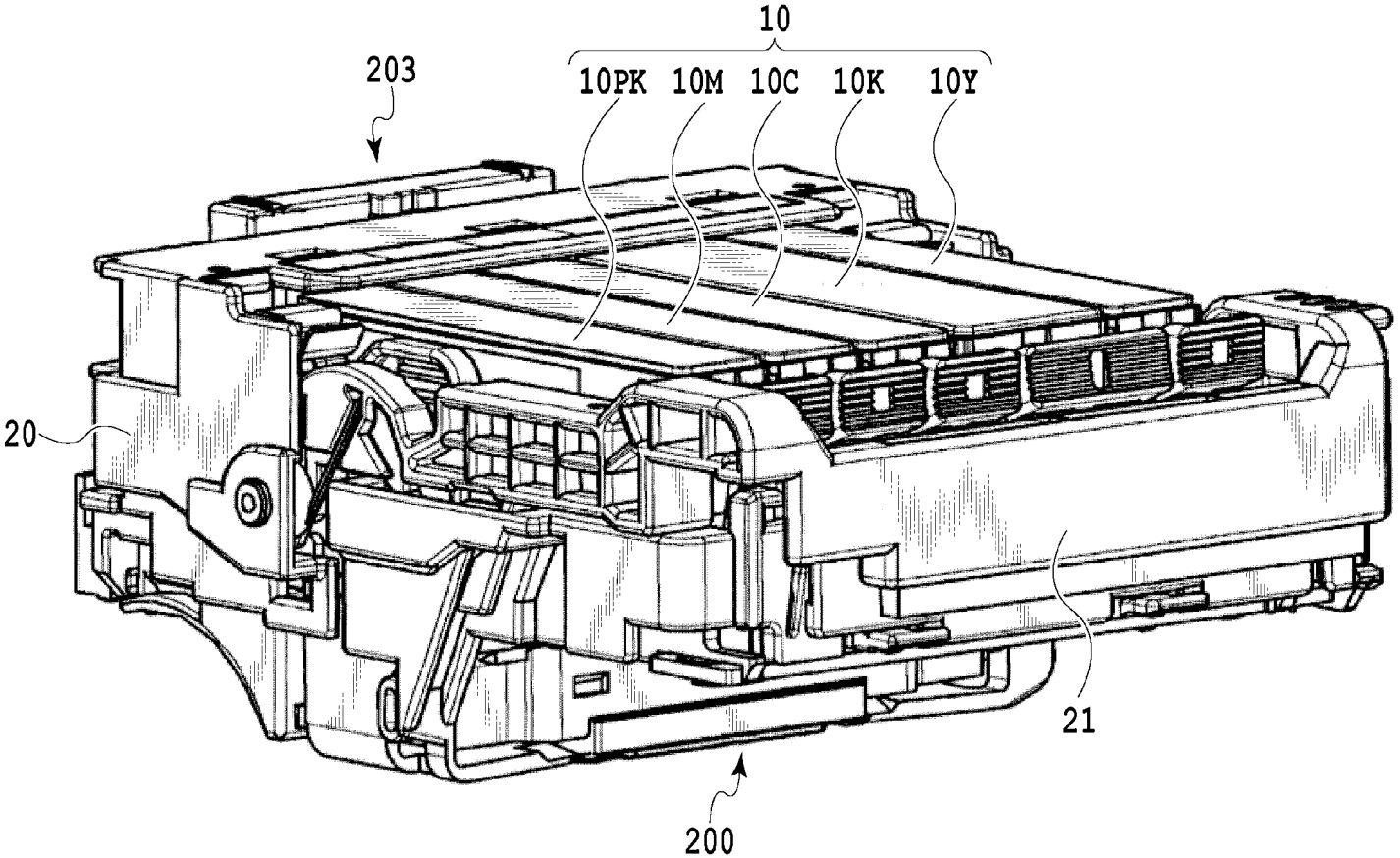
FIG. 2 is an enlarged perspective view showing a printing section of the printing apparatus in FIG. 1.
Figure 3:
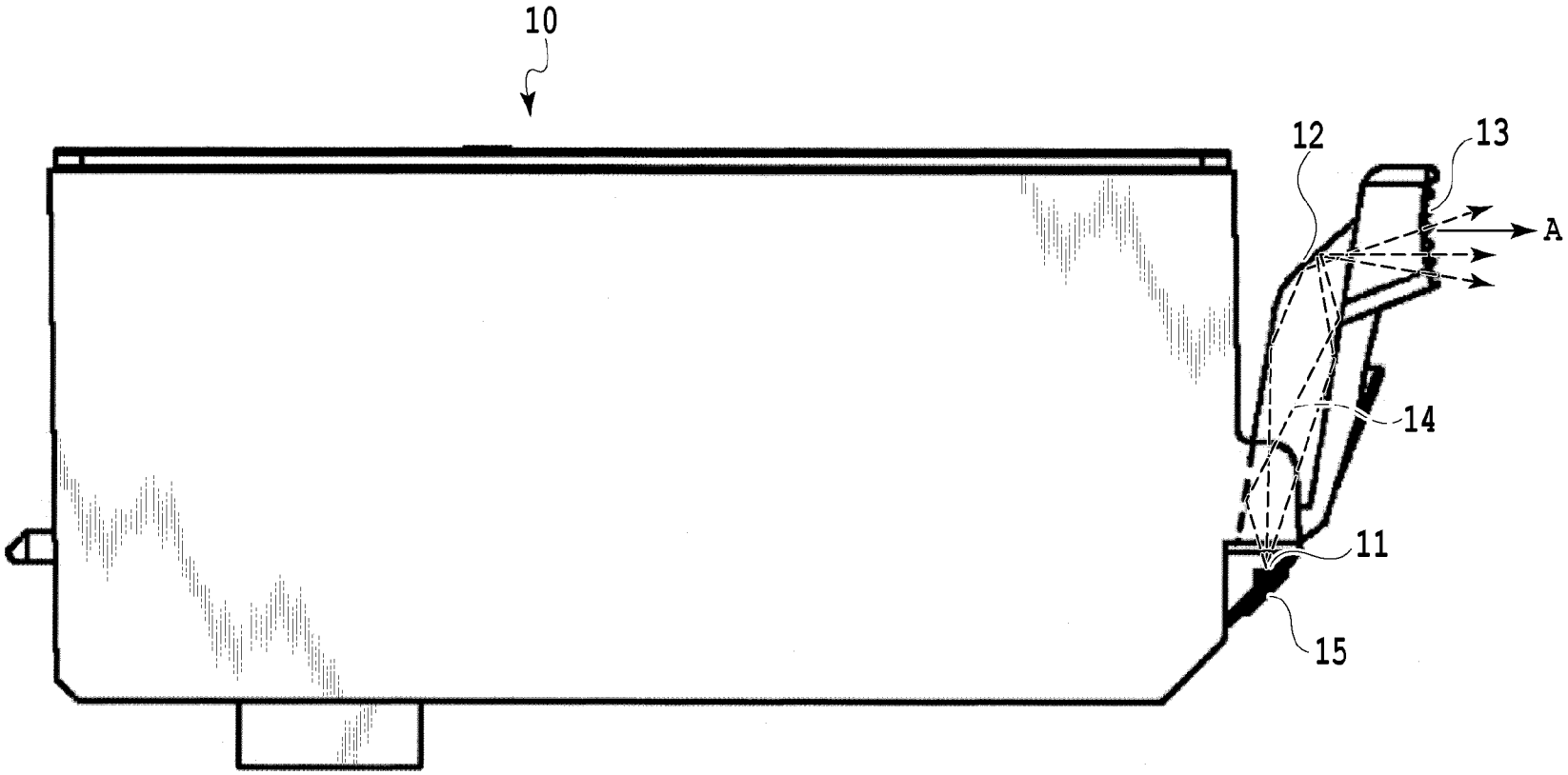
FIG. 3 is a side view showing an ink tank mounted on a carriage in the printing section in FIG. 2.

FIG. 2 shows a perspective view of the printing section 203. FIG. 3 shows a side view of the ink tank 10.

The print head 200 and the ink tank 10 are held so as to be attachable to and detachable from the carriage 20. The ink tank 10 is configured so as to be attached to and detached from the carriage 20 by operating a carriage lever 21.

The ink tank 10 include independent ink tanks 10K, 10PK, 10C, 10M, and 10Y for the respective colors. As shown in FIG. 3, the ink tank 10 is equipped with a board 15 on which a LED 11 is mounted. The ink tank 10 is provided with an irradiation section 13 that emits, when the LED 11 generates light, the light to a light receiving section described below. Furthermore, to guide the light emitted by the LED 11 to the irradiation section 13, an optical path 14 is formed between the LED 11 and the irradiation section 13.

The light emitted by the LED 11 is guided through a light guiding section 12, and the irradiation section 13 delivers the light in a direction A in FIG. 3. At this time, the light passes through the optical path 14 shown in FIG. 3, from the LED 11 toward the irradiation section 13. A tank holder section 22 (FIG. 6) of the carriage 20 is provided with connectors (not shown in the drawings) corresponding to the respective ink tanks. Each of the connectors contacts a pad on the board 15 in the ink tank 10 mounted on the carriage 20. Each connector is connected to a carriage board (not shown in the drawings) and to a control board via a flexible cable or the like. Thus, the LED 11 for each ink tank 10 can be controlled to be lighted or blinked.

Figure 4:
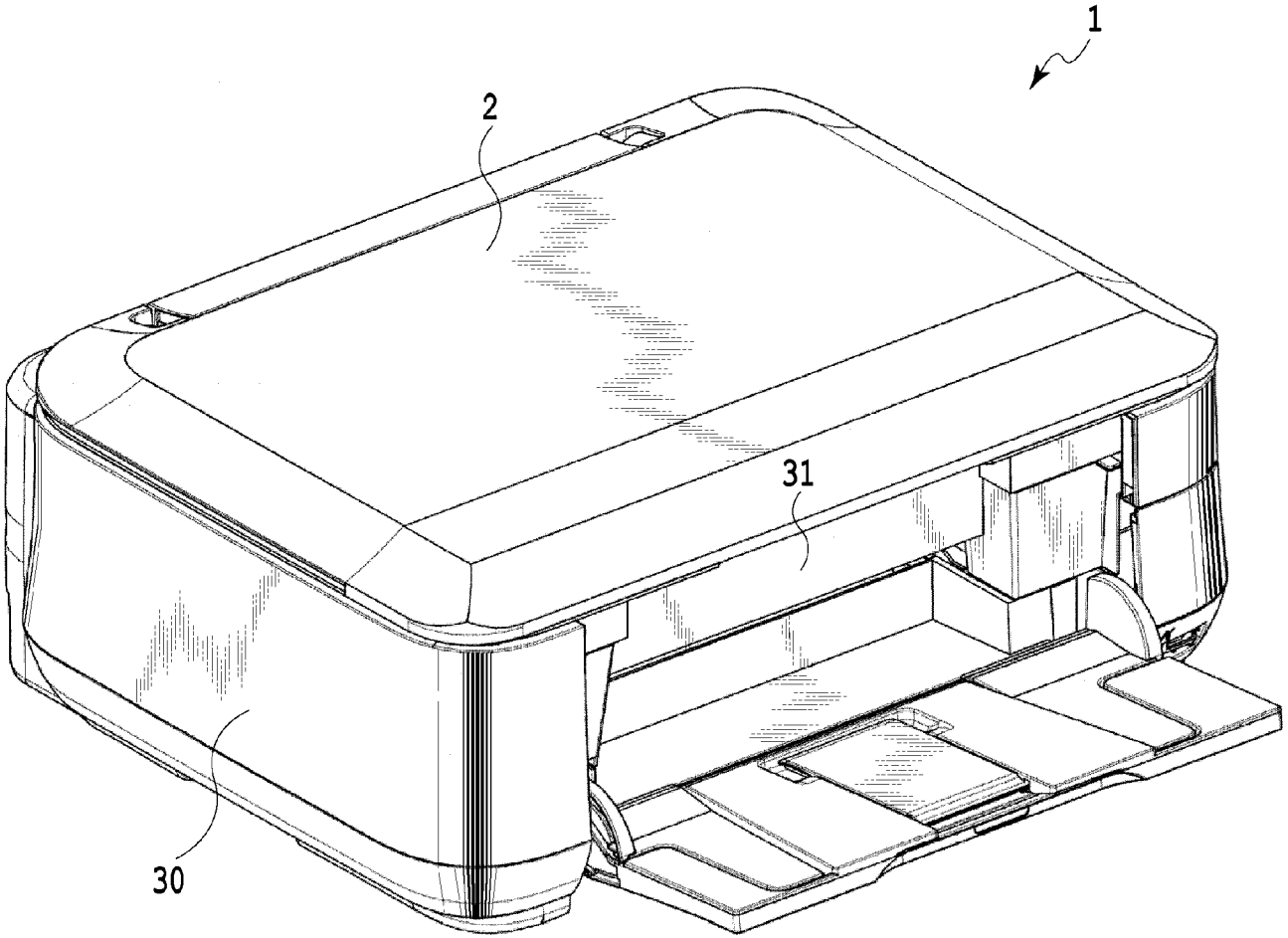
FIG. 4 is a perspective view showing a general configuration of the printing apparatus on which a housing is mounted.
Figure 5:
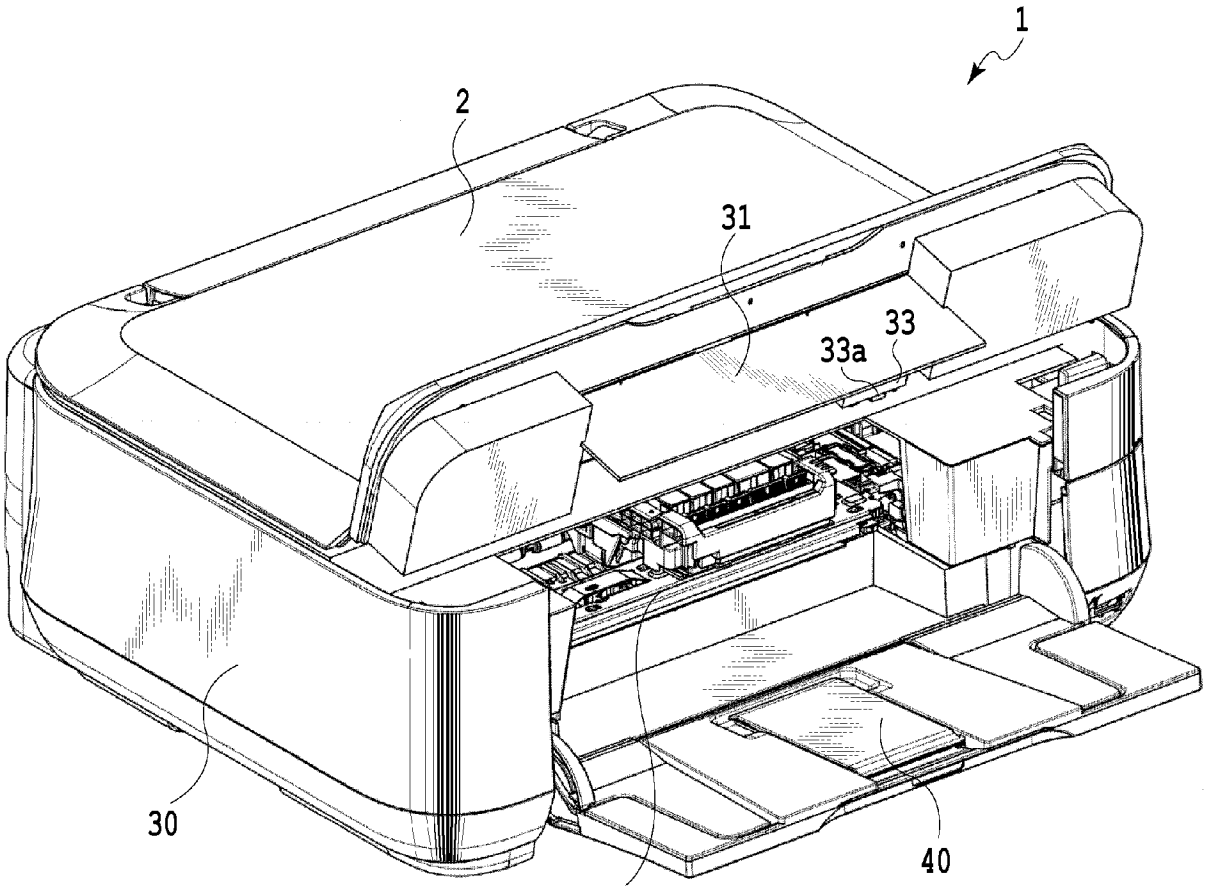
FIG. 5 is a perspective view showing the printing apparatus in FIG. 4 in which a cover is open.

FIG. 4 shows a perspective view of the appearance of the printing apparatus 1 in which a cover 31 is closed. FIG. 5 shows a perspective view of the appearance of the printing apparatus 1 in which the cover 31 is open.

The printing apparatus 1 has a housing 30. The housing 30 is configured such that the carriage 20 with the ink tank 10 and the print head 200 mounted thereon can be housed inside the housing 30 and at any position throughout the housing 30 in the main scan direction of the printing apparatus 1. The printing apparatus 1 according to the present embodiment is a multifunction printer with a reading apparatus 2 provided on an upper surface of the housing 30. Main internal components of the above-described printing apparatus 1 are housed in the housing 30. The housing 30 is provided with an opening 32 through which the ink tank 10 is open to the exterior while the ink tank 10 is mounted on the carriage 20. An openable and closable cover 31 is provided on the housing 30 at a position forward of the reading apparatus. The cover 31 is formed so as to be able to cover at least a part of the opening 32 formed in the housing 30. The cover 31 may entirely or partly cover the opening 32. Furthermore, in the present embodiment, the cover 31 is configured so as to cover, when closed, an upper part of a front surface of the printing apparatus 1. A sheet discharge section 40 is formed on a downstream side of the ink tank 10 along a conveying direction of the print medium in the printing apparatus 1.

Figure 6:
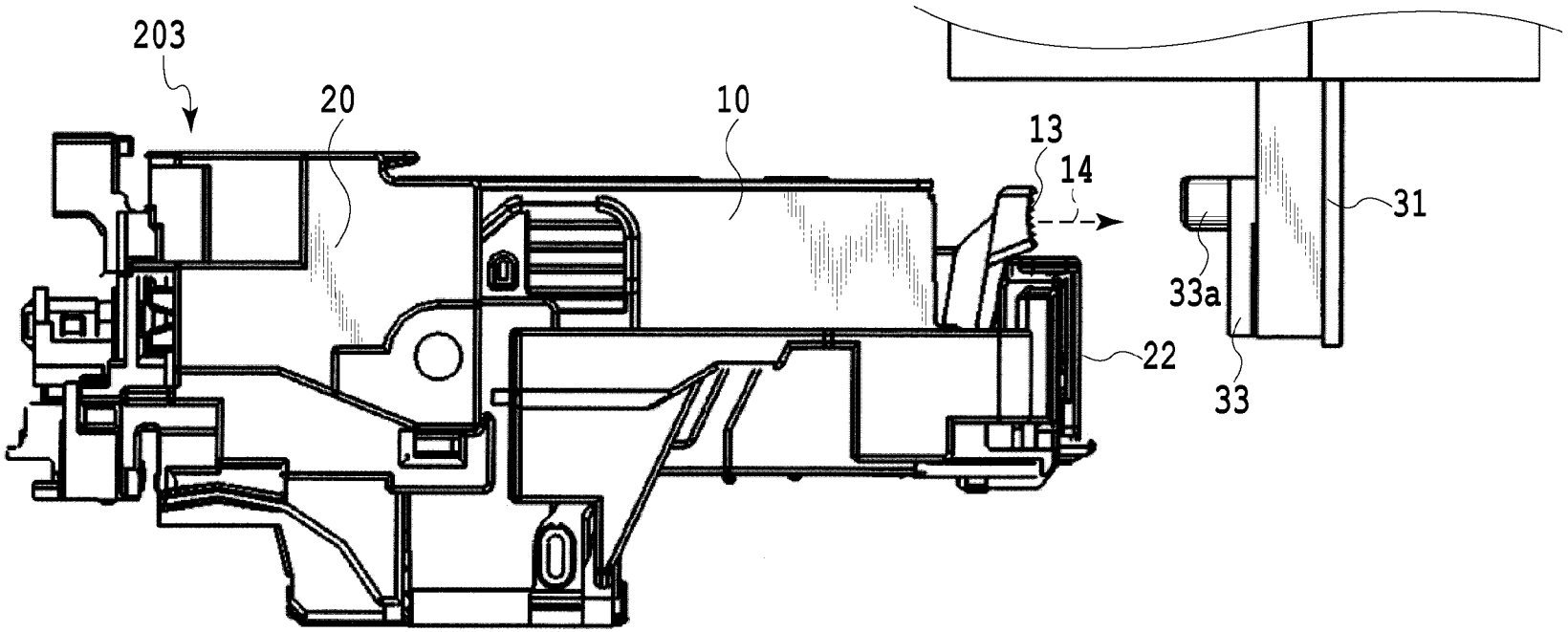
FIG. 6 is a side view showing a positional relation between a light emitting section in the ink tank and a light receiving section attached to the cover in the printing apparatus shown in FIG. 4.

FIG. 6 is a side cross-sectional view showing the printing section 203 and a light receiving section 33*a* that receives light from the irradiation section 13, in the printing apparatus 1. In the present embodiment, the cover 31 is provided with a photo sensor board unit 33 including the light receiving section (light receiving element) 33*a*, serving as a photo sensor. That is, in the present embodiment, the light receiving section 33*a* is fixedly attached to the cover 31. As shown in FIG. 6, the light receiving section 33*a* is attached to the cover 31 at an inner position thereof. The position where the light receiving section 33*a* is attached is not limited to the inner position on the cover 31 but may be a lower tip of the cover 31. The light receiving section 33*a* is configured such that a photocurrent varies in accordance with the amount of light received. The photo sensor board unit 33 is preferably provided away from the recovery section 204 in the main scan direction. This allows suppression of adhesion of ink mist suspended in the apparatus main body to the light receiving section 33*a* near the recovery section 204, resulting in a noise factor with respect to the amount of light received. Furthermore, the light receiving section 33*a* is provided on an extension of the optical path 14 so as to be able to receive light from the irradiation section 13 of the ink tank 10 in case that the cover 31 is closed. The photo sensor board unit 33 is connected to the control board (not shown in the drawings) via the cable (not shown in the drawings).

The light receiving section 33*a*, serving as light receiving unit, receives light emitted by the LED 11, serving as light emitting unit to allow detection of whether or not each ink tank 10 is mounted on the carriage 20. When whether or not the ink tank 10 is mounted on the carriage 20 is detected, the carriage 20 moves to a predetermined position so as to place the ink tank 10 at a position opposite to the light receiving section 33*a*. When the carriage 20 performs scanning to place the ink tank 10 at the position opposite to the light receiving section 33*a*, the LED 11 emits light at the corresponding position.

In the present embodiment, when the respective ink tanks 10 are mounted on the carriage 20, light emitted by the LEDs 11 attached to the respective ink tanks 10 is received by the light receiving section 33*a*. The control unit on the printing apparatus 1 side detects that the light receiving section 33*a* has received the light and can thus detect that the ink tank 10 is appropriately attached to the carriage 20. Thus, in the present embodiment, information indicating whether or not the ink tank 10 is mounted on the carriage 20 is acquired by obtaining information indicating whether or not the light receiving section 33*a* receives light emitted by the LED 11 in the ink tank 10. That is, in the present embodiment, the LED 11 and the light receiving section 33*a* function as a detection section that allows acquisition of information indicating whether or not the printing-agent housing containers is mounted on the mounting unit. In the present embodiment, the control section such as the CPU functions as a detection section that determines whether or not the ink tank 10 is mounted at a mounting position on the carriage 20.

Furthermore, the present embodiment enables determination of whether or not each ink tank 10 is appropriately mounted on the carriage 20 at a mounting position. The LED 11 and the light receiving section 33*a* enable determination of whether or not each ink tank 10 is appropriately disposed at a predetermined disposition position. Additionally, the determination of whether or not the ink tank is appropriately mounted on the carriage 20 may allow determination not only of whether or not the ink tank 10 is disposed at an appropriate position in the carriage 20 but also of whether or not the ink tank 10 is appropriately directed or oriented. When the ink tank 10 is mounted in an incorrect direction or in an inclined state, light emitted by the ink tank 10 may fail to reach the light receiving section 33*a*.

The housing 30 is provided with a sensor (not shown in the drawings) that allows an open/close status of the cover 31 to be monitored. Whether the cover 31 is opened or closed is determined based on the result of detection by the sensor. Furthermore, the housing 30 has the opening 32 in a front surface. The housing 30 is configured such that the user can access the interior of the printing apparatus 1 via the opening 32. The opening 32 is formed above the sheet discharge section 40 into which printed print media are discharged. In this regard, the upper position of the sheet discharge section 40 is not limited to a position immediately above the sheet discharge section 40. The opening 32 includes an area displaced from the position of the sheet discharge section 40 in the conveying direction of the print medium. In the present embodiment, the opening 32 is formed at a position between the position of the ink tank 10 and the position where the sheet discharge section 40 is formed.

When the cover 31 is opened to open the printing section 203 with the ink tank 10 mounted therein to the exterior via the opening 32 as shown in FIG. 5, the user can access the ink tank 10 through the opening 32, formed in the housing 30. The opening 32 is formed as an entry to a space in which the ink tank 10 is replaced or in which a print medium jammed inside the printing apparatus 1 is dealt with.

The length of the opening 32 along the main scan direction is approximately equivalent to the corresponding maximum width of the print medium. In this regard, the printing apparatus 1 is configured to have a reduced apparatus width, and thus, when the printing section 203 is positioned at the leftmost end (the end opposite to the recovery section 204) in the main scan direction, the ink tank 10Y is exposed to the exterior through the opening 32.

The reading apparatus 2 is fixed to the housing 30. In the present embodiment, the photo sensor board unit 33 is fixed to the cover 31. Thus, when the cover 31 is opened, the cover 31 moves and also the photo sensor board unit 33 moves to retract from an area opposite to the irradiation section 13 of the ink tank 10. Consequently, a wide opening area for attachment and detachment of the ink tank can be secured at the opening 32 on a printing apparatus front surface side of the ink tank 10. As described above, in the printing apparatus 1, when the cover 31 is opened, the detection section, which allows acquisition of information indicating whether or not the ink tank 10 is mounted on the carriage 20, can move in the retracting direction from the opening 32. In the present embodiment, the light receiving section 33*a* moves in the retracting direction from the opening 32.

Figure 7:
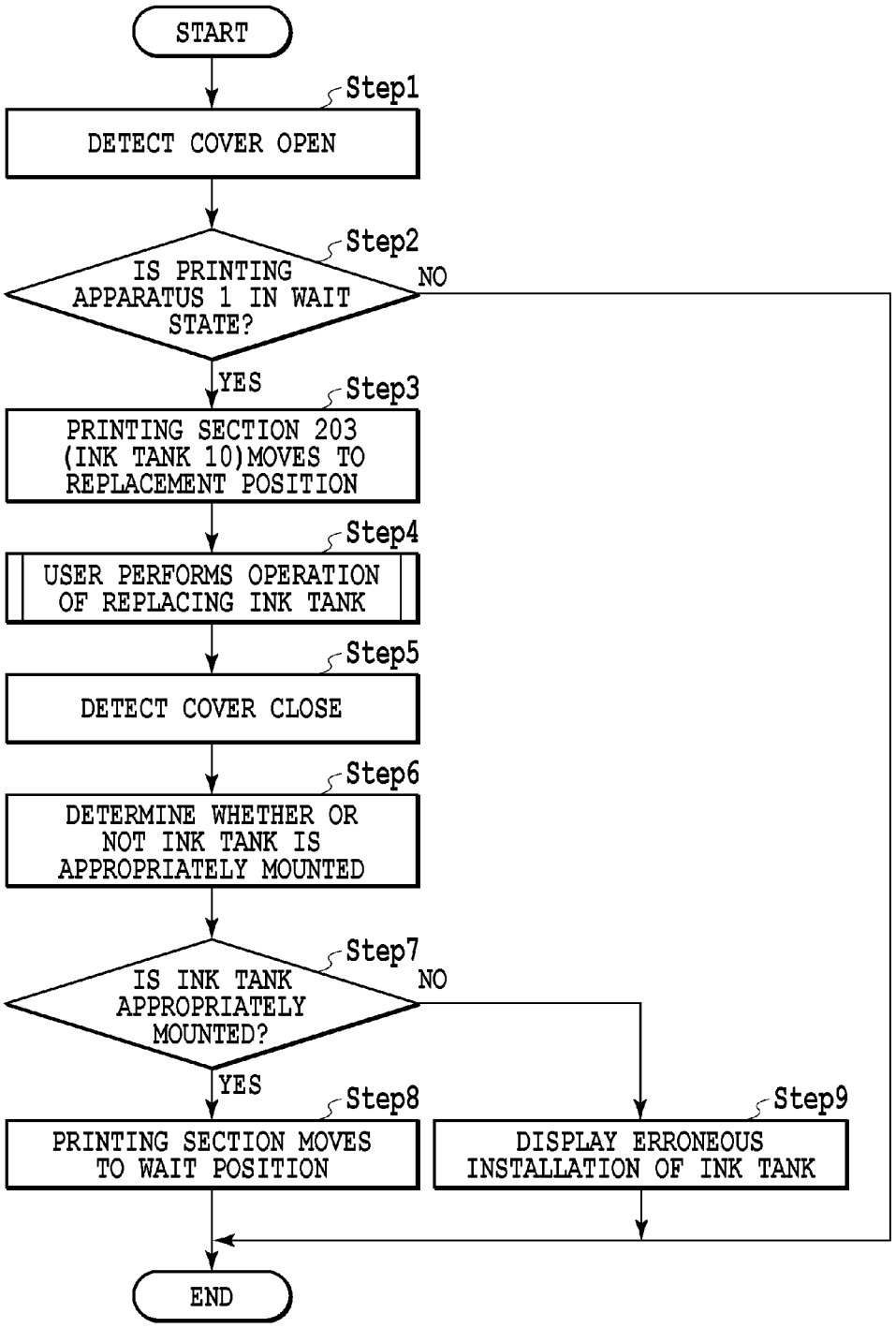
FIG. 7 is a flowchart showing a flow of an operation of replacing the ink tank in the printing apparatus in FIG. 4.

Now, operations for replacement of the ink tank 10 will be described with reference to FIG. 7. When the user opens the cover 31 in order to replace the ink tank 10, cover detection unit detects that the cover 31 is open (step 1). Replacement of the ink tank 10 is allowed only when the printing apparatus 1 is in a wait state. When the printing apparatus 1 is not in the wait state but is performing a printing operation or the like, an ink tank replacement sequence is not initiated even when cover open is detected. The control unit determines whether or not the printing apparatus 1 is in the wait state (step 2). When the printing apparatus 1 is in the wait state, the printing section 203 with the ink tank 10 mounted therein moves to an ink tank replacement position (step 3). The user replaces the desired ink tank 10, that is, one of the ink tanks 10K, 10PK, 10C, 10M, and 10Y (step S4). Then, when the cover 31 is closed, the cover detection unit detects this (step 5). When the cover detection unit determines that the cover 31 is closed, an ink tank installation position detection operation is performed in order to check whether the replaced ink tank 10 is installed at the correct position. To allow the light receiving section 33*a* to receive light emitted by each ink tank 10, the LEDs 11 in the ink tanks 10K, 10PK, 10C, 10M, and 10Y are sequentially allowed to emit light while the printing section 203 is being moved. Based on the current positional information on the printing section 203 and the current information regarding emitting on each ink tank 10, whether or not the ink tank 10 is mounted at the correct position in the correct orientation is determined (step 6). The control unit determines whether or not each ink tank 10 is appropriately mounted (step 7). As described above, the printing apparatus 1 can determine whether or not the ink tank 10 is mounted on the carriage 20 while the cover 31 is closed. When the printing apparatus 1 detects that each ink tank 10 is mounted, the printing section 203 moves to a printing wait position (step 8). When any ink tank 10 fails to be appropriately mounted, the display section displays erroneous installation of the ink tank 10 to notify the user the erroneous installation (step 9).

As described above in the embodiment, when the cover 31 is opened, the light receiving section 33*a* moves in conjunction with movement of the cover 31.

Since the light receiving section 33*a* thus moves in the retracting direction from the opening 32 along with the cover 31, the area of the opening 32 increases. Consequently, the user can easily access the ink tank 10. Furthermore, when the user performs an operation on the ink tank, the operation can be facilitated. For example, when an operation of replacing the ink tank 10 is performed, the replacement operation can be facilitated. Additionally, when the print medium is jammed in a conveying path for the print medium inside the housing 30, an operation of removing the jammed print medium can be facilitated.

In the present embodiment, the configuration has been described in which, as the cover 31 moves, the light receiving section 33*a* moves in the same direction as that in which the cover 31 moves. However, the present invention is not limited to this configuration. The light receiving section 33*a* may move in a direction different from the direction in which the cover 31 moves. The light receiving section 33*a* may move in the retracting direction from the opening 32. In this regard, the movement in the retracting direction from the opening 32 refers to such movement as results in an increased area of the opening 32. Thus, the movement in the retracting direction from the opening 32 includes movement in the main scan direction. Movement so that the light receiving section 33*a* retracts from the opening 32 in the main scan direction is included in the movement in the retracting direction. That is, the moving direction may be movement along the same planar direction as that of the opening 32 formed in the housing 30 or movement in a direction intersecting the same planar direction as that of the opening 32 as direction of movement of the cover 31. The movement also includes such rotational movement as results in an increased area of the opening 32.

Furthermore, in the above description of the printing apparatus 1, the ink tank 10 is provided with the LED 11, serving as a light emitting section, and the photo sensor board unit 33 with the light receiving section 33*a* is fixed to the cover 31. The configurations of the light receiving section and the light emitting section are not limited to the above-described embodiment. The light receiving section and the light emitting section may have the reverse positional relation. That is, similar effects can be produced by providing the ink tank 10 side with the light receiving section, while providing the cover 31 side with the light emitting section. Additionally, in the present embodiment, the light receiving section 33*a* is attached to the cover 31. However, the present invention is not limited to this configuration. The light receiving section 33*a* may be attached to the housing 30 instead of being attached to the cover 31 as long as the light receiving section 33*a* moves in the retracting direction from the opening 32 when the cover 31 is opened. In this manner, one of the LED 11 and the light receiving section 33*a* may be attached to the ink tank 10 or to the carriage 20, whereas the other the LED 11 and the light receiving section 33*a* may be attached to the housing 30 or the cover 31.

Furthermore, the LED 11, serving as light emitting unit, need not be provided in the ink tank 10 but may be provided on the carriage 20 side with the ink tank 10 mounted thereon. In this case, the ink tank 10 may be provided only with the light guiding section. At this time, the installation position of the ink tank 10 can be detected by varying the positional relation between an incident section (not shown in the drawings) of the light guiding section of the ink tank 10 and the LED (not shown in the drawings) provided on the carriage 20, among the ink tanks 10K, 10PK, 10C, 10M, and 10Y. Furthermore, the LEDs 11 may emit light in different colors depending on the colors for the ink tanks 10. Detection of the type of light allows determination of to which of the colors each ink tank 10 corresponds and determination, for each type of ink tank 10, of whether the ink tank 10 is appropriately disposed at the exact position. In this case, the printing apparatus 1 can determine, for each disposition position, whether or not the correct type of ink tank 10 is mounted on the carriage 20.

Furthermore, light emitted by the light emitting unit is not limited to visible light. The light emitted by the light emitting unit may be invisible light such as ultraviolet light or infrared light which is invisible. The light receiving section may be configured to be able to detect invisible light such as ultraviolet light or infrared light which is emitted by the light emitting unit upon receiving the light.

As described above, the present embodiment can provide a printing apparatus that can be miniaturized without degrading operability for replacement of consumables such as the ink tank and a process for dealing with a jammed print medium. Furthermore, the present embodiment enables an increase in the area of the opening 32, through which the operation of replacing the ink tank or the process of dealing with the jammed print medium is executed without getting larger size of the printing apparatus. The present embodiment can thus contribute to miniaturizing the printing apparatus.

Second Embodiment

Now, a printing apparatus according to a second embodiment of the present invention will be described. Sections of the second embodiment which are configured similarly to the corresponding sections of the first embodiment are denoted by the same reference numerals throughout the drawings.

In the first embodiment, the printing apparatus is provided with the sensor serving as cover detection unit to monitor the open/close status of the cover 31. Thus, the open/close status of the cover is detected in step 5 in the flowchart in FIG. 7. In contrast, the printing apparatus of the second embodiment is not provided with cover detection unit for monitoring the open/close status of the cover 31. In the second embodiment, the open/close status of the cover 31 is determined based on the output result from the light receiving section 33*a* of the photo sensor board unit 33 and other output results. Specifically, in the present embodiment, the open/close status of the cover 31 is determined based on the result of detection by the light receiving section 33*a*, the presence or absence of light emission from the ink tank 10, and whether or not the ink tank is located at a predetermined detection position.

FIG. 8 shows a table for the output results for determination of whether the cover is open or closed according to the present embodiment. In the present embodiment, the open/close status of the cover 31 is determined based on the output results indicating the presence or absence of light reception and detection by the light receiving section 33*a*, the presence or absence of light emission from the LED 11 in the ink tank 10, and whether or not the carriage is located at a predetermined position in the main scan direction.

The light receiving section 33*a* receives light emitted by the ink tank and determines the presence of light reception and detection upon detecting that a predetermined amount of light is being received.

Furthermore, the presence or absence of light emission from the LED 11 in the ink tank 10 is detected to allow determination of whether or not the ink tank 10 is mounted on the carriage. The information on the presence or absence of light emission from the LED 11 is obtained from control information for the LED 11. Thus, detecting the presence or absence of light emission from the LED 11 in the ink tank 10 allows detection of the information indicating whether the ink tank 10 has been installed in or removed from the carriage 20 when the LED 11 is allowed to emit light. When the ink tank 10 is mounted on the carriage 20, the control section of the printing apparatus allows the LED 11 attached to the ink tank 10 to emit light, and light emission from the LED 11 is detected, then the presence of light emission from the LED 11 is detected.

Additionally, whether or not the ink tank 10 is located at a predetermined ink tank detection position opposite to the light receiving section 33*a* is determined. Whether or not the ink tank 10 is located at the predetermined ink tank detection position is determined by detecting the position of the ink tank and determining whether the detected position is the predetermined ink tank detection position. When the detected position of the ink tank coincides with the predetermined ink tank detection position, this leads to the determination that the ink tank is located at the predetermined ink tank detection position. When the detected position of the ink tank is different from the predetermined ink tank detection position, this leads to the determination that the ink tank is not located at the predetermined ink tank detection position. In the present embodiment, positional information on the carriage in the main scan direction is calculated from the positional information on the printing section 203 based on print data and the like.

When the light receiving section 33*a* receives light and the presence of light reception is detected, light emission information on the LED 11 in the ink tank 10 and positional information on the ink tank 10 are checked. When the ink tank 10 is mounted on the carriage, light emission from the LED 11 is detected, and the presence of the carriage at the predetermined ink tank detection position is detected, then the open/close status of the cover 31 is determined to be cover close in which the cover is closed (condition 1).

When the light receiving section 33*a* receives light and the presence of light reception is detected, the light receiving section 33*a* is determined to be receiving light from the exterior if light emission from the LED 11 in the ink tank is detected and the carriage is not located at the predetermined ink tank detection position. At this time, the open/close status of the cover 31 is determined to be cover open state in which the cover is open (condition 2).

When the presence of light reception by the light receiving section 33*a* is detected but light emission from the ink tank 10 is not detected and the absence of light emission is detected, the light receiving section 33*a* is determined to detect light from the exterior. Then, the open/close status of the cover 31 is determined to be cover open regardless of the ink tank detection position information (condition 3).

When the light receiving section 33*a* is determined to receive no light but light emission from the LED 11 in the ink tank 10 is detected and the presence of the carriage at an ink tank detection position opposite to the light receiving section 33*a*, then the open/close status of the cover 31 is determined to be cover open (condition 4). This is because the cover 31 is not opened enough to allow the light receiving section 33*a* to receive light from the exterior and the cover 31 is slightly open to cause the light receiving section 33*a* to be displaced from the optical path 14 for the ink tank 10, resulting in detection of the absence of light reception by the light receiving section 33*a*.

Furthermore, when the light receiving section 33*a* is determined to receive no light and the determination result is negative in either the determination of whether or not light is emitted by the LED 11 in the ink tank 10 or the determination of whether the carriage is located at the detection position opposite to the light receiving section 33*a*, then the open/close status of the cover 31 is determined to be cover close (conditions 5 and 6).

If the light receiving section 33*a* is determined to receive light, light emission from the ink tank 10 is detected, and the presence of the carriage at the predetermined detection position is detected, so that the (condition 1) is met (cover close), when the cover 31 is opened, then the (condition 4) is met, resulting in the cover open state. This is because, after the cover 31 is opened and while the light receiving section 33*a* is moving, the light receiving section 33*a* fails, at any position, to receive light from the ink tank 10, resulting in detection of the absence of light reception.

When, in spite of the (condition 4) being met, the position of the carriage 20 and light emission from the ink tank 10 remain unchanged and the light receiving section 33*a* detects light from the exterior, then the printing apparatus 1 meets the (condition 1). Thus, even though the cover 31 is open, the light receiving section 33*a* may detect light from the exterior and the open/close status of the cover 31 may be determined to be cover close, resulting in misdetection of the open/close status. This may be avoided as follows. If the light receiving section 33*a* temporarily receives no light and the open/close status of the cover 31 is determined to be cover open, the LED 11 in the ink tank 10 may be turned off or blinked when the ink tank 10 is mounted in the carriage 20. A state may thus be established where, even though the ink tank 10 is mounted on the carriage 20, light emission from the LED 11 is prevented from being detected. Then, the open/close status of the cover 31 is temporarily determined to be cover open, so that, when whether the ink tank 10 is mounted on the carriage 20 is determined, the open/close status of the cover 31 can be determined depending on the presence or absence of light reception by the light receiving section 33*a*. In the present embodiment, the open/close status of the cover 31 can be determined depending on whether the (condition 3) or the (condition 6) is met based on the presence or absence of light reception by the light receiving section 33*a*. When light reception is detected in the light receiving section 33*a*, detection of light from the exterior is determined, and the (condition 3) is met, allowing the open/close status of the cover 31 to be determined to be cover open. Furthermore, when no light reception is detected in the light receiving section 33*a*, no light from the exterior is detected, and the (condition 6) is met, allowing the open/close status of the cover 31 to be determined to be cover close in which the cover 31 is closed. Thus, the open/close status of the cover 31 can be more accurately determined depending on the presence or absence of light reception by the light receiving section 33*a*. As described above, in some cases, the light emission from the LED 11 in the ink tank 10 may be stopped, allowing the open/close status of the cover 31 to be easily detected.

For detection of the open/close status of the cover 31, the LED 11 in at least one of the ink tanks 10K, 10PK, 10C, 10M, and 10Y may be allowed to emit light during the printing operation in order to reduce the amount of time from the start of open/close detection until the detection. Furthermore, during the printing operation, a position detecting operation is not performed which involves determining whether the carriage is located at the detection position opposite to the light receiving section 33*a*. Thus, the LED 11 in the ink tank 10 may be off while the printing operation is being performed.

If the LED 11 is constantly allowed to emit light while the ink tank 10 is mounted on the carriage 20, the irradiation section 13 of the ink tank 10 frequently passes through the position opposite to the light receiving section 33*a* during the printing operation. When the light receiving section 33*a* fails to detect the presence of light reception at the time of the passage, the (condition 4) is met, and the open/close status of the cover 31 can be determined to be cover open.

Figure 9:
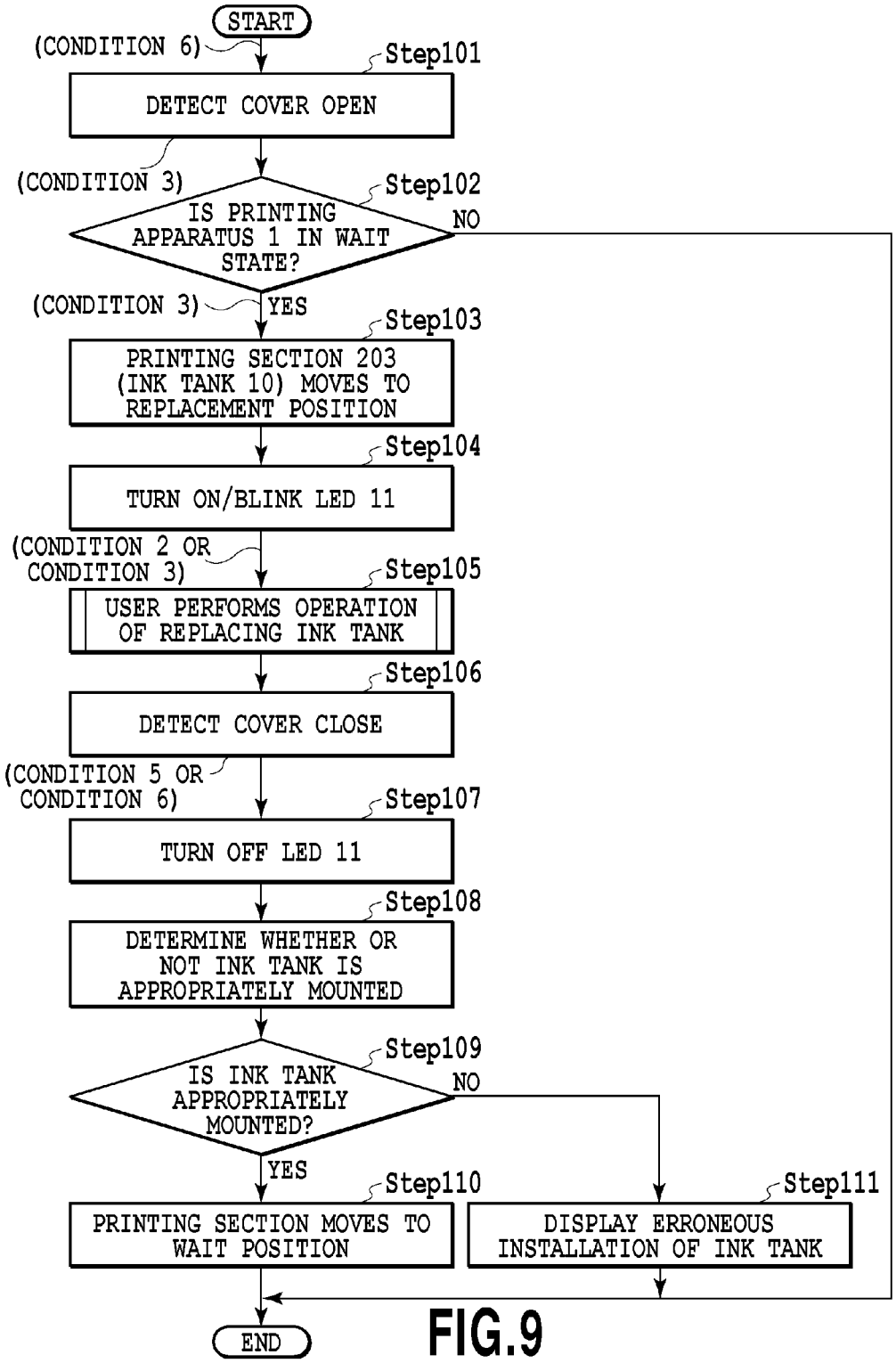
FIG. 9 is a flowchart showing a flow of an operation of replacing an ink tank in a printing apparatus according to a second embodiment of the present invention.

Now, an ink tank position detection operation for ink tank replacement according to the present embodiment will be described with reference to FIG. 9. In this case, replacement of the ink tank 10 is allowed only when the printing apparatus 1 is in the wait state.

When the printing apparatus 1 is not in the wait state but is performing the printing operation or the like, the ink tank replacement sequence is not initiated even when the open state where the cover is open is detected.

When the printing apparatus 1 is in the wait state, the LED 11 in the ink tank 10 is off according to the present embodiment. Thus, when detection of the presence or absence of light emission from the LED 11 in the ink tank 10 is performed, the presence of light emission is not detected. Furthermore, at this time, the ink tank 10 is at a wait position different from the detection position opposite to the light receiving section 33*a*. Thus, the (condition 6) is met by the detection results indicating the presence or absence of light emission from the LED 11 and whether or not the carriage is at the wait position, respectively.

In this state, when the user opens the cover 31 in order to replace the ink tank 10, the (condition 3) is met, and opening of the cover 31 is detected (step 101). Then, the control unit determines whether or not the printing apparatus 1 is in the wait state (step 102). When the printing apparatus 1 is in the wait state, the printing section 203 with the ink tank 10 mounted therein moves to an ink tank replacement position (step 103). At this time, based on information on the reaming amount of ink in the ink tank 10, which of the ink tanks 10 needs to be replaced can be clearly indicated to the user by blinking or turning on the LED 11 (step 104).

In the present embodiment, light emission from the LED 11 is started after the ink tank 10 moves to a predetermined detection position for replacement. This is to avid determining the open/close status of the cover 31 to be cover close when the (condition 1) is met as a result of detection of light from the exterior and light emission from the ink tank 10 even though the cover 31 is opened before the operation of replacing the ink tank 10 is performed. The carriage 20 moves to the ink tank replacement position to allow the LED 11 to emit light. Then, when the cover 31 is opened, the state of the printing apparatus 1 shifts to the (condition 2).

Then, the desired one of the ink tanks 10K, 10PK, 10C, 10M, and 10Y is replaced (step 105).

When the user closes the cover 31 after replacing the desired one of the ink tanks 10K, 10PK, 10C, 10M, and 10Y, the (condition 5) is met, and the printing apparatus 1 detects the cover close status (step 106). At this time, even if the LED 11 is not emitting light (this state includes a temporary off state during blinking), the (condition 6) is met, and the printing apparatus 1 detects the cover close status. When the printing apparatus 1 detects the cover close status, the LED 11 in the ink tank 10 is turned off (step 107).

Subsequently, to check whether the replaced ink tank 10 is installed on the carriage at the correct position, the printing apparatus 1 shifts to the ink tank installation position detection operation. In the ink tank installation position detection operation, the carriage is scanned to move the printing section 203, while the LEDs 11 in the ink tanks 10K, 10PK, 10C, 10M, and 10Y are sequentially allowed to emit light. Based on the positional information on the printing section 203 and the light emission information on the ink tank 10, whether each ink tank is mounted on the carriage at the correct position is determined (step 108).

At this time, temporarily turning off the LED 11 while the ink tank 10 is at the detection position allows determination of whether or not the cover has been opened during the ink tank installation position detection operation. If the cover is opened during the ink tank installation position detection operation, the printing apparatus 1 meets the (condition 3). If the cover is not opened during the ink tank installation position detection operation, the printing apparatus 1 meets the (condition 6). The control unit determines whether or not each ink tank 10 is correctly installed and appropriately mounted (step 109). If each ink tank 10 is appropriately mounted, the printing section 203 moves to the printing wait position (step 110). If each ink tank 10 is installed at an incorrect position, the display section indicates and reports the erroneous installation of the ink tank 10 to the user (step 111).

As described above, the printing apparatus 1 has light emission detection unit that can detect when the LED 11 emits light. In the present embodiment, the control section of the printing apparatus 1 detects when the LED 11 emits light. Furthermore, the printing apparatus 1 determines whether or not the ink tank 10 is located at a predetermined position along the main scan direction. In the present embodiment, the control section of the printing apparatus 1 functions as position detection unit for determining whether or not the ink tank 10 is located at a predetermined position along the main scan direction. Moreover, in the present embodiment, whether or not the light receiving section 33*a* has received light is determined. In the present embodiment, the open/close status of the cover 31 is determined based on the result of determination of the presence or absence of light reception by the light receiving section 33*a*, the result of determination of whether or not the LED 11 has emitted light and the result of determination of whether or not the ink tank 10 is located at the predetermined position along the main scan direction.

As described above, according to the present embodiment, the open/close status of the cover 31 is determined based on the detection results. This allows omission of such a sensor configuration that allows monitoring of the open/close status of the cover 31 as used in the first embodiment. Thus, manufacturing costs for the printing apparatus can be suppressed.

Third Embodiment

Now, a third embodiment of the present invention will be described. Components of the third embodiment similar to the corresponding components of the first embodiment and the second embodiment are denoted by the same reference numerals and will thus not be described below. Only differences from the first embodiment and the second embodiment will be described.

Figure 10:
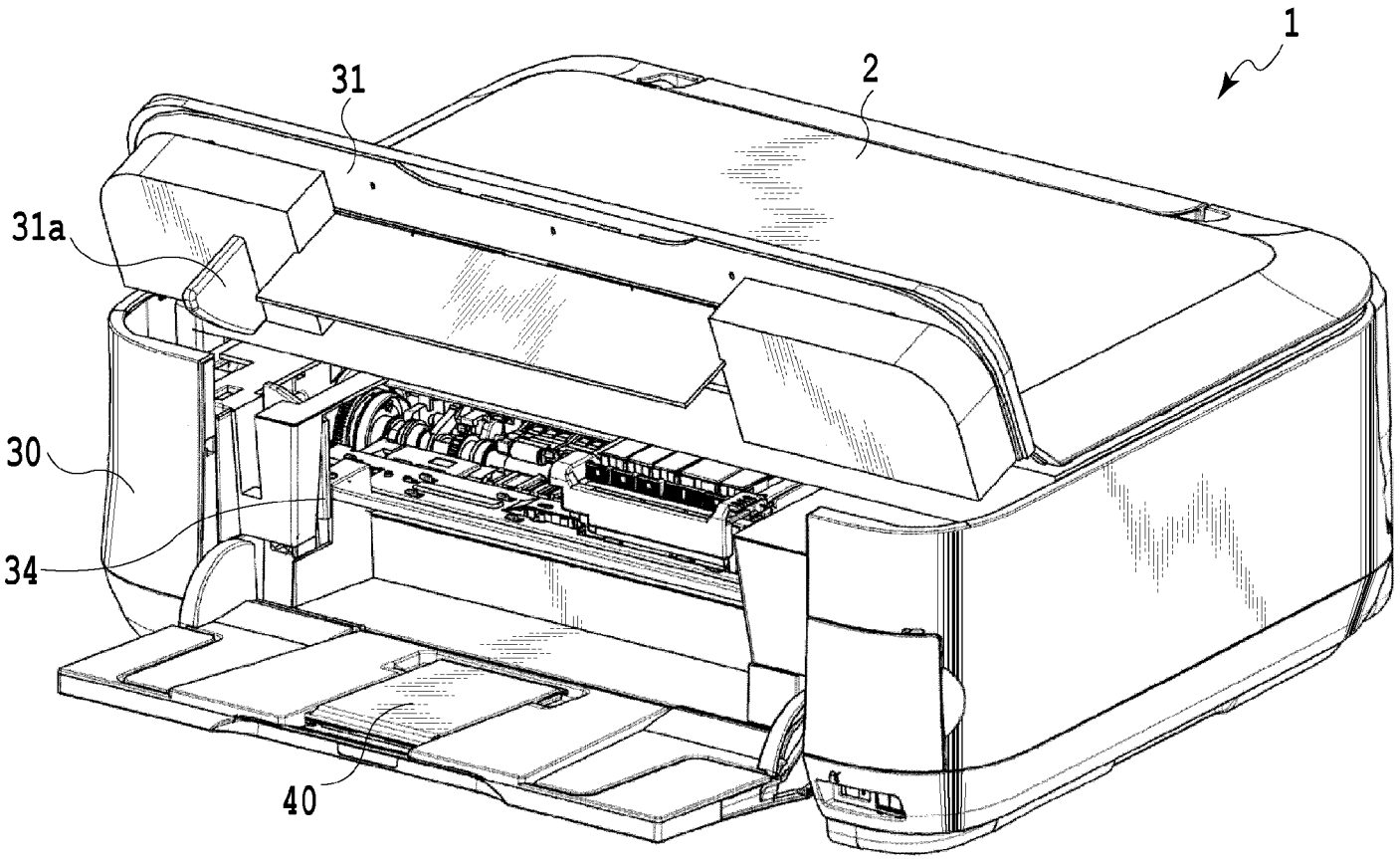
FIG. 10 is a perspective view showing a printing apparatus according to a third embodiment of the present invention in which a cover is open.
Figure 11:
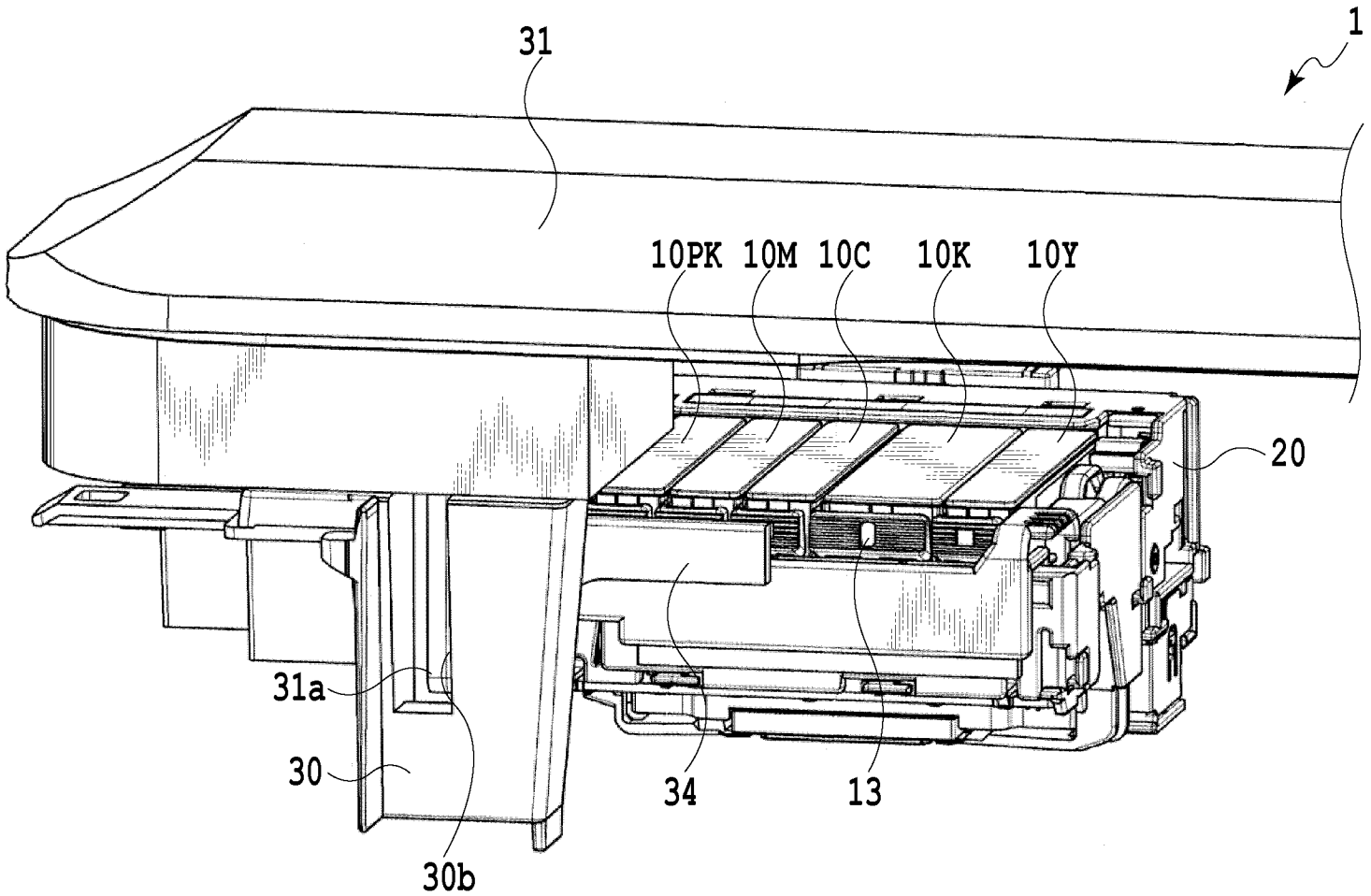
FIG. 11 is a perspective view showing an important part of the printing apparatus in FIG. 10 in which the cover is closed.
Figure 12:
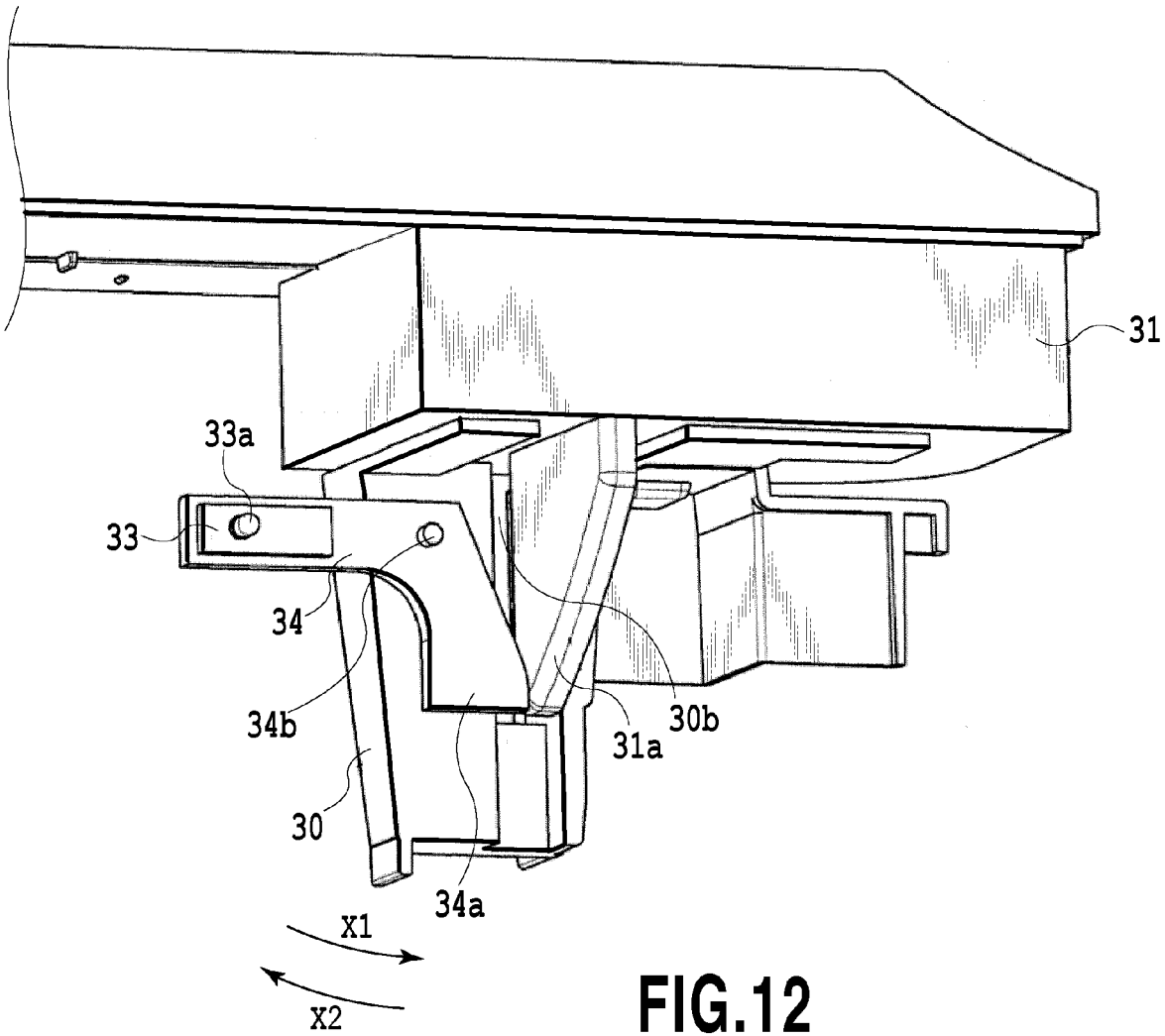
FIG. 12 is a perspective view showing the important part of the printing apparatus in FIG. 10 in which the cover is closed, as seen from the inside of the printing apparatus.
Figure 13:
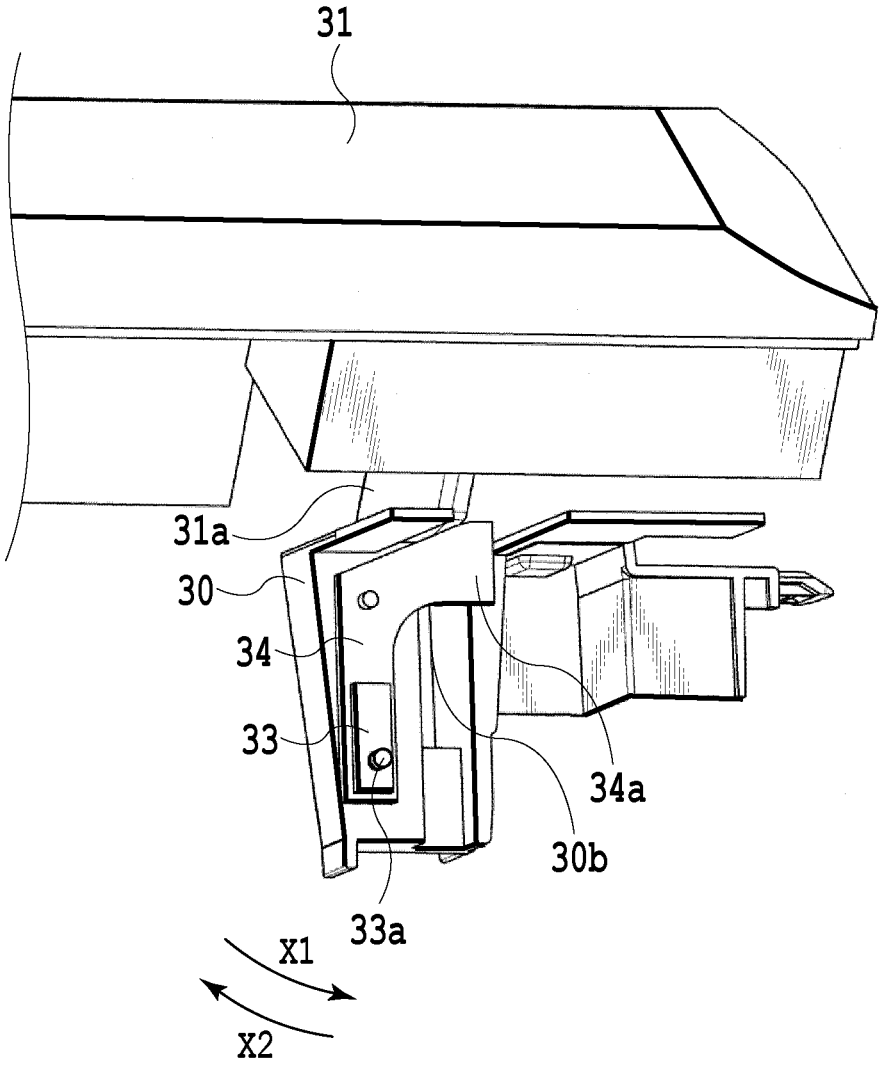
FIG. 13 is a perspective view showing the important part of the printing apparatus in FIG. 10 in which the cover is open, as seen from the inside of the printing apparatus.

FIG. 10 shows a perspective view of a printing apparatus 1 according to the third embodiment. FIG. 11 is a perspective view showing the periphery of a photo sensor board unit 33 and an ink tank 10 in the printing apparatus in the state where a cover 31 is closed. FIG. 12 is a perspective view showing the periphery of the photo sensor board unit 33 in the state where the cover 31 is closed, as seen from the inside of the housing 30. Furthermore, FIG. 13 is a perspective view of the periphery of the photo sensor board unit 33 in the state where the cover 31 is open, as seen from the inside of the housing 30.

In the first embodiment, the printing apparatus is configured such that, when the light receiving section 33*a* is attached to the cover 31 and the cover 31 is opened, the light receiving section 33*a* simultaneously moves in the retracting direction from the opening. In contrast, in the third embodiment, a cam is attached to the cover 31, and the light receiving section 33*a* is attached to the cover 31 so as to be biased in the retracting direction from the opening. With the cover closed, the light receiving section 33*a* is pushed by the cam and thus placed at a position corresponding to a light emission section of the ink tank 10. The printing apparatus is configured such that, when the cover is opened, the cam leaves the light receiving section 33*a* to move the light receiving section 33*a* in the retracting direction from the opening.

As shown in FIG. 10, the cover 31 is provided with a cam section (cam member) 31*a*. Furthermore, the photo sensor board unit 33 with the light receiving section 33*a* is movably attached to the housing 30 so as to be biased. In the present embodiment, the photo sensor board unit 33 with the light receiving section 33*a* is pivotally attached to the housing 30 so as to be biased in a direction X1 shown in FIGS. 12 and 13. The photo sensor board unit 33 is fixedly attached to a sensor holder 34. Thus, the light receiving section 33*a* is fixedly attached to the sensor holder 34. The sensor holder 34 is attached to the housing 30 so as to be able to pivot around a shaft 34*b* (FIG. 12 and FIG. 13).

When the cover 31 is open, the cam section 31*a* is positioned away from the housing 30 as shown in FIG. 10. Thus, the cam section 31*a* moves as described above and is thus exposed to the exterior of the housing 30.

FIG. 11 shows the positional relation between the ink tank 10 and the sensor holder 34 observed when the cover 31 is closed. For description, apart of the cover 31 is omitted. With the cover 31 closed, the light receiving section (photo sensor) 33*a* of the photo sensor board unit 33 is placed at a position corresponding to an irradiation section 13 of the ink tank 10 so as to be able to receive light from the irradiation section 13 of the ink tank 10. That is, the light receiving section 33*a* is placed so as to lie on an optical path 14 of light emitted by the irradiation section 13 of the ink tank 10.

FIG. 12 shows a perspective view of the periphery of the sensor holder 34 and the cam section 31*a* of the cover 31 in the state where the cover 31 is closed. When the cover 31 moves from an open state to a closed state, the cam section 31*a* attached to the cover 31 also moves similarly to the cover 31. As a result of movement of the cam section 31*a*, the cam section 31*a* goes into the housing 30 and into a cutout portion 30*b* formed in the housing 30. When the cam section 31*a* moves in conjunction with movement of the cover 31 and into the cutout portion 30*b*, the cam section 31*a* comes into abutting contact with the sensor holder 34. As a result, one end of the sensor holder 34 is pushed by the cam section 31*a*, and thus, the sensor holder 34 moves pivotally around the shaft 34*b* in a direction X2 shown in FIGS. 12 and 13. The pivotal movement of the sensor holder 34 places the light receiving section 33*a* at a position opposite to the irradiation section 13 of the ink tank 10. With the cover 31 closed, the sensor holder 34 with the light receiving section 33*a* formed thereon comes into abutting contact with the cam section 31*a*. Thus, the light receiving section 33*a* is placed at a position where the light receiving section 33*a* can determine whether or not the ink tank 10 is installed. Furthermore, while the cover 31 is kept closed, the sensor holder 34 remains pushed by the cam section 31*a*. Thus, while the cover 31 is closed, the light receiving section 33*a* remains at the position corresponding to the irradiation section 13 of the ink tank 10.

When the cover 31 is opened, the cam section 31*a* attached to the cover 31 moves away from the inside of the housing 30 and comes free from the cutout portion 30*b* as shown in FIG. 13. When the cam section 31*a* is separated from the cutout portion 30*b*, nothing holds the sensor holder 34. Thus, the sensor holder 34 attached to the housing 30 in a biased manner moves pivotally around the shaft 34*b* in a direction X1 shown in FIGS. 12 and 13. When the sensor holder 34 is pivotally moved in the direction X1 by the bias force, a portion of the sensor holder 34 located around the light receiving section 33*a* moves in the retracting direction from the opening 32 in the housing 30.

Thus, when the cover 31 is opened, the cam section 31*a* is separated from the sensor holder 34, which moves in the retracting direction from the opening 32. Consequently, the light receiving section 33*a* moves in the retracting direction from the opening 32. Thus, the sensor holder 34 moves away from an area of the opening 32 closer to a central portion thereof to increase the area of the opening 32. Thus, the user can access to the ink tank 10 easily. In this manner, a sufficient opening area for installation and removal of the ink tank 10 can be secured in a printing apparatus front surface side of the ink tank 10.

In the above-described embodiment, the configuration has been described in which the light receiving section 33*a* placed at a position where the light receiving section 33*a* receives light from the LED 11 provided in the ink tank 10 moves in the retracting direction from the opening 32. However, the present invention is not limited to this configuration. The light receiving section 33*a* may be attached to the ink tank 10, and the LED 11 may be placed at the position of the housing 30 corresponding to the light receiving section 33*a*, so that, when the cover 31 is opened, LED 11 retracts from the opening 32. In other words, the positions of the light receiving section and the light emitting section may be reversed to the positions in the present embodiment.

In addition, the LED 11 need not be provided in the ink tank 10. The LED 11 may be provided on the carriage 20 with the ink tank 10 mounted thereon, and the ink tank 10 may be provided only with the light guiding section that guides light to the irradiation section 13. Furthermore, when the LED 11 is provided on the housing 30 side, the light receiving section 33*a* may be provided on the carriage 20 rather than in the ink tank 10. Additionally, the light guiding section need not necessarily provided, and light receiving section 33*a* may directly receive light from the LED 11.

Furthermore, at a position where the sensor holder 34 retracts when the cover 31 is opened, a main body LED light source may be provided at the position opposite to the light receiving section 33*a*. In the second embodiment, the light receiving section 33*a* is allowed to detect light from the exterior to determine the open/close status of the cover 31. However, the present invention is not limited to this configuration. An alternative configuration may be provided in which the LED is disposed at the position corresponding to the light receiving section 33*a* when the cover 31 is opened so that the cover is determined to be open when the light receiving section 33*a* receives light from the LED. In this case, the open/close status of the cover 31 can be more accurately monitored by setting a difference between the amount of light from the LED 11 in the ink tank 10 and the amount of light from the LED light source placed at the position corresponding to the light receiving section 33*a* when the cover 31 is opened. Additionally, the LED light source placed at the position corresponding to the light receiving section 33*a* when the cover 31 is opened need not necessarily be exclusively used but may be configured to work also as a LED indicative of a power on state of the printing apparatus 1.

Furthermore, in the above-described embodiment, the configuration has been described in which the sensor holder 34 with the light receiving section 33*a* attached thereto moves pivotally. However, the present invention is not limited to this configuration. The light emitting section or the light receiving section may be displaced by movement other than pivotal movement. The light emitting section or the light receiving section may be displaced by moving in a direction horizontal to the surface of the housing 30 in which the opening 32 is formed or moving in a direction intersecting the surface of the housing 30 in which the opening 32 is formed. The light emitting section or the light receiving section may move in the retracting direction from the opening 32 when the cover 31 is opened.

Fourth Embodiment

Now, a fourth embodiment of the present invention will be described. Components of the fourth embodiment similar to the corresponding components of the first to third embodiments are denoted by the same reference numerals and will thus not be described below. Only differences from the first to third embodiments will be described.

The above-described first embodiment adopts the configuration in which the light receiving section 33*a* is attached to the cover so that, when the cover 31 is opened, the cover 31 moves and the light receiving section 33*a* also moves in the retracting direction from the opening 32. Furthermore, in the third embodiment, the cam section 31*a* is attached to the cover 31, and the sensor holder 34 with the light receiving section 33*a* is pivotally movably attached to the housing 30. When the cover 31 is closed, the light receiving section 33*a* is pushed by the cam section 31*a* and placed at a position corresponding to the ink tank 10. When the cover is opened, the cam section 31*a* comes free to move the light receiving section 33*a* in the retracting direction from the opening 32. In contrast, in the fourth embodiment, a light guide 36 that guides light delivered by the irradiation section 13 of the ink tank 10 to the light receiving section 33*a* is attached to the cover 31. When the cover 31 is opened, the cover 31 moves and the light guide 36 also moves in the retracting direction from the opening 32.

Figure 14:
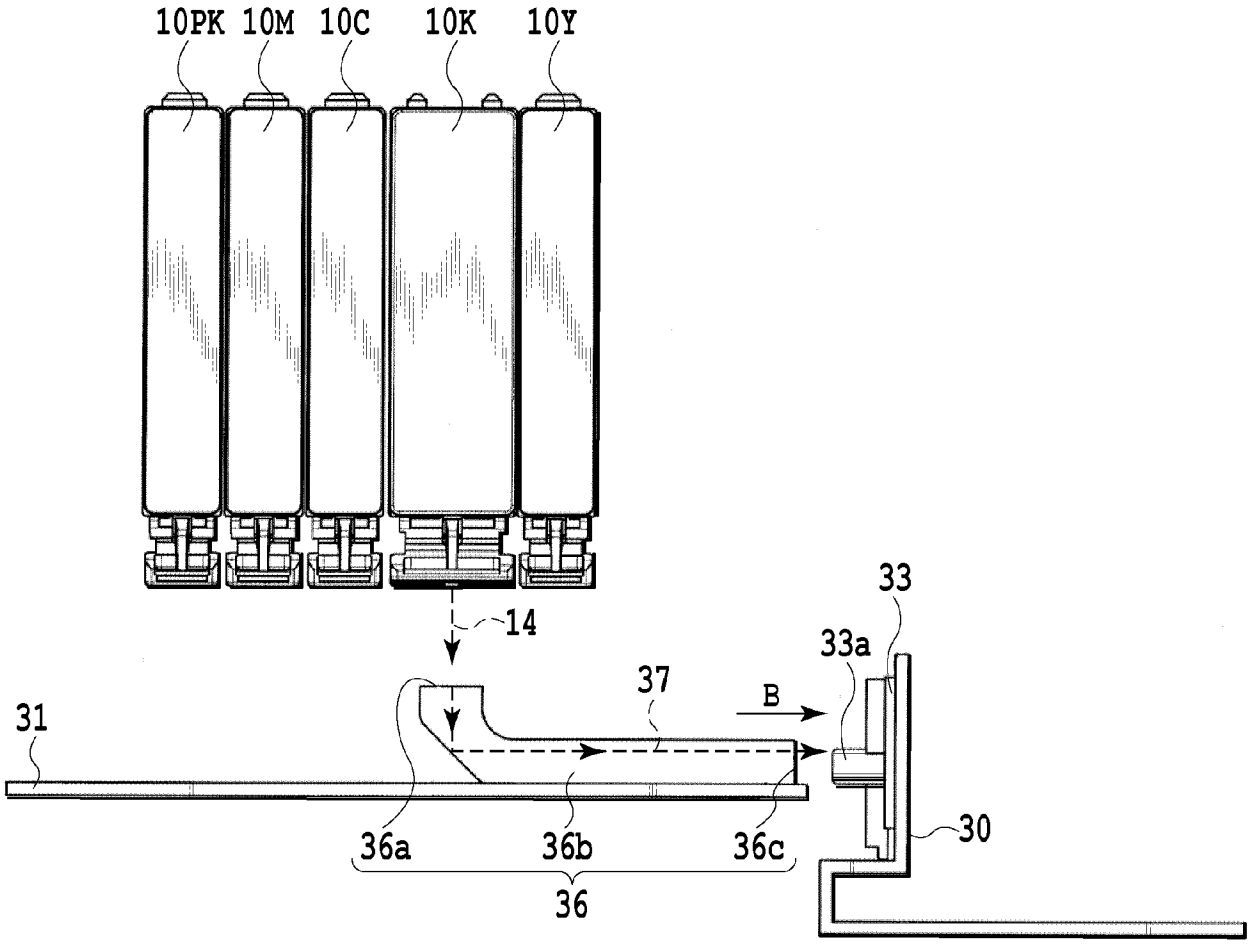
FIG. 14 is a plan view showing an ink tank, a light guide, and a light receiving section in the printing apparatus according to the fourth embodiment of the present invention.

FIG. 14 is a plan view showing a configuration of an important part of the printing apparatus according to the fourth embodiment. The light guide 36 is attached to the cover 31. The light guide 36 has an incident section 36*a*, a light guide section 36*b* including a reflection surface or the like, and an irradiation section 36*c*. The light guide 36 enables light entering the light guide 36 through the incident section 36*a* to be guided to the irradiation section 36*c* via the light guide section 36*b* so that the light is delivered by the irradiation section 36*c*.

The photo sensor board unit 33 with the light receiving section 33*a* fixedly attached to the housing 30.

The light guide 36 is disposed such that, when the cover 31 is closed, the position of the incident section 36*a* coincides with the position corresponding to the irradiation section 13 of the ink tank 10. Furthermore, the light guide 36 is disposed such that, when the cover 31 is closed, the position of the irradiation section 36*c* of the light guide 36 coincides with the position corresponding to the light receiving section 33*a* attached to the housing 30. Thus, with the cover 31 closed, light delivered by the irradiation section 13 of the ink tank 10 can be received by the light receiving section 33*a*. In the present embodiment, the light guide section 36*b* guides light received by the incident section 36*a* and is provided with an optical path 37 that guides the light from the irradiation section 36*c* in a direction B shown in FIG. 14. As described above, light receiving unit including the light receiving section 33*a* has a light guide 36 through which light emitted by the LED 11 is internally passed and the light receiving section 33*a* that receives the light having passed through the light guide 36. The light receiving section 33*a* receives light from the light guide 36 to enable acquisition of information on whether or not the ink tank 10 is appropriately installed on the carriage 20.

When light from the irradiation section 13 of the ink tank 10 is directly received by the light receiving section 33*a*, misdetection may occur when whether the ink tank 10 lies at the predetermined detection position is determined. The diffusion of light from the irradiation section 13 may cause erroneous determination of the presence of the ink tank 10 even though the ink tank 10 is actually not present. Thus, in the present embodiment, misdetection may be suppressed by avoiding aligning the optical path 14 defined by the irradiation section 13 of the ink tank 10 with the optical path 37 defined by the irradiation section 36*c* of the light guide 36. Thus, detection accuracy can be improved when whether the ink tank 10 lies at the predetermined detection position is determined.

Thus, in the present embodiment, the light receiving section 33*a* is provided on the optical path 37 so that the light receiving section 33*a* can receive light from the irradiation section 36*c* of the light guide 36 when the cover 31 is closed. Thus, as is the case with the first embodiment, the ink tank detection position is set to be the position of the ink tank where the ink tank reaches such a predetermined position as allows light from the ink tank 10 to enter the light guide 36, and whether the ink tank lies at the predetermined ink tank detection position can be determined.

When the cover 31 is opened, the cover 31 moves and also the light guide 36 moves to retract the light guide 36 from the position opposite to the irradiation section 13 of the ink tank 10. Thus, in the present embodiment, when the cover 31 is opened, the light guide 36 can move in the retracting direction from the opening 32. This increases the area of the opening 32 provided by opening the cover 31, allowing the user to easily access the ink tank 10. Consequently, operations of installing and removing the ink tank 10 can be easily performed.

Fifth Embodiment

Now, a fifth embodiment of the present invention will be described. Components of the fifth embodiment similar to the corresponding components of the first to fourth embodiments are denoted by the same reference numerals and will thus not be described below. Only differences from the first to fourth embodiments will be described.

In the third embodiment, the light receiving section 33*a* is pivotally movably attached to the housing 30. In the fourth embodiment, the light guide 36 attached to the cover guides light emitted by the ink tank 10 to the light receiving section 33*a*. In the fifth embodiment, a light guide 38 is pivotally movably to the housing 30. When the cover 31 is closed, the cam section 31*a* attached to the cover 31 pushes a part of the light guide 38 to place an irradiation section 38*a* of the light guide 38 at the position corresponding to the irradiation section 13 of the ink tank 10. Furthermore, the light guide 38 is attached to the housing 30 in a biased manner. When the cover 31 is opened, the light guide 38 moves pivotally to increase the area of the opening 32 compared to the state where the cover 31 is closed.

Figure 15:
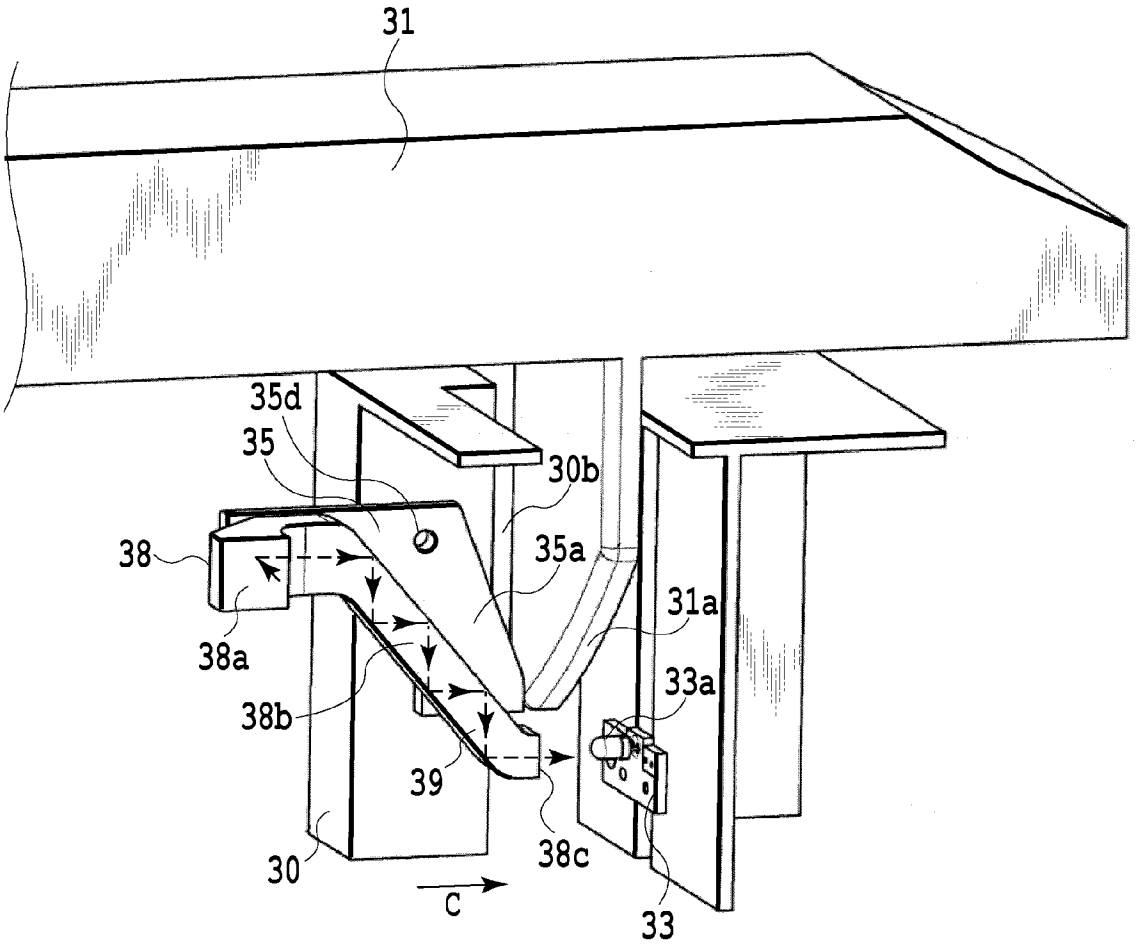
FIG. 15 is a perspective view showing an important part of a printing apparatus according to a fifth embodiment of the present invention in which a cover is closed, as seen from the inside of the printing apparatus.
Figure 16:
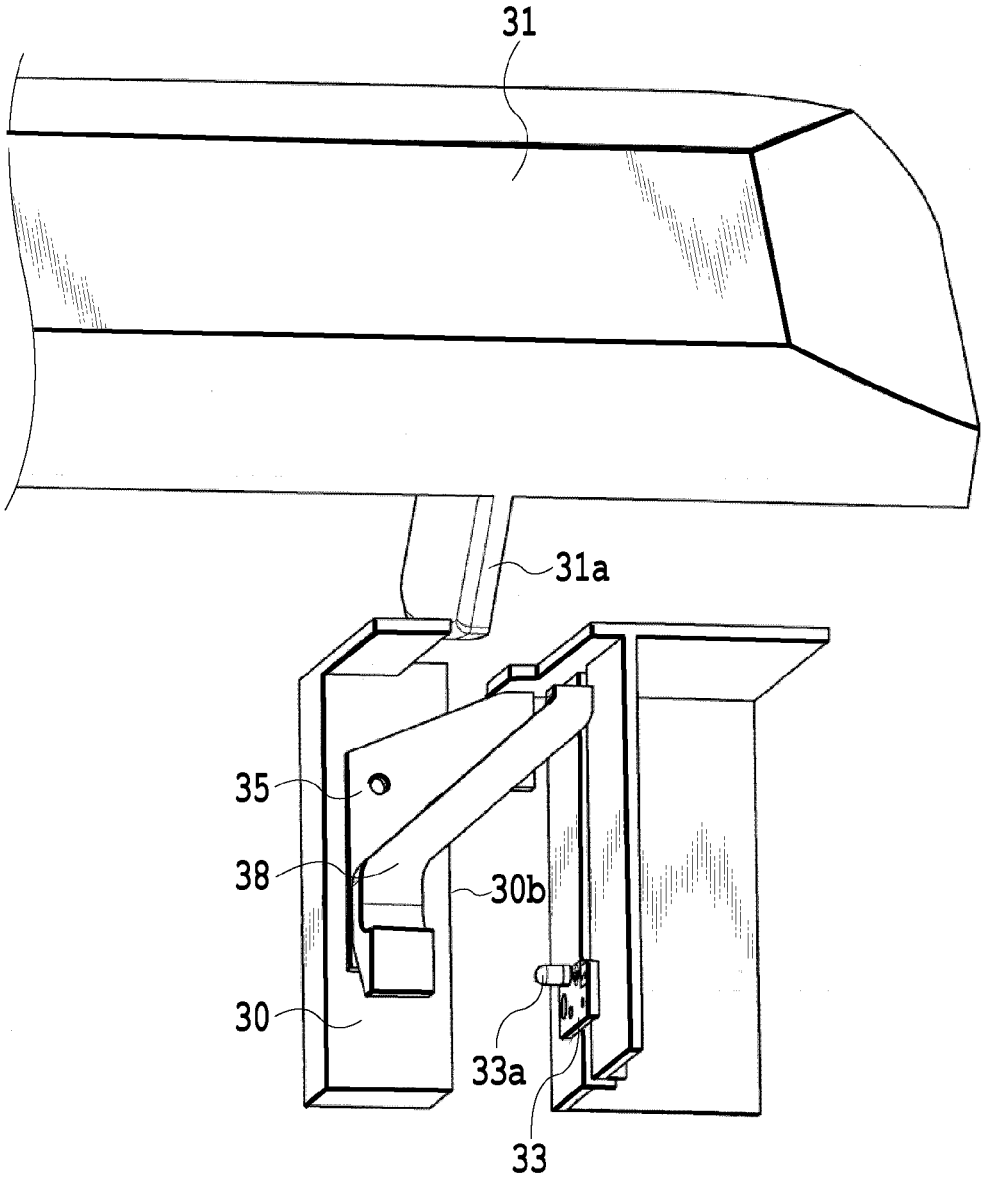
FIG. 16 is a perspective view showing the important part of the printing apparatus in FIG. 15 in which the cover is open, as seen from the inside of the printing apparatus.

FIG. 15 is a perspective view of an important part of the printing apparatus in which the cover 31 is closed according to the fifth embodiment. FIG. 16 is a perspective view of an important part of the printing apparatus in which the cover 31 is open according to the fifth embodiment.

In the present embodiment, the light guide 38 is attached to the housing 30 so as to be able to pivot around a pivotal shaft 35*d*. The light guide 38 is fixedly attached to a lever section 35. The lever 35 moves pivotally to move the light guide 38 pivotally in conjunction with movement of the lever section 35. Furthermore, the lever section 35 and the light guide 38 are attached to the housing 30 in a biased manner so as to enter a state shown in FIG. 16 when the cover 31 is opened.

The cover 31 is provided with the cam section 31*a*. When the cover 31 is closed, the cam section 31*a* comes into abutting contact with the light guide 38. This enables the light guide 38 to move pivotally.

The light guide 38 has an incident section 38*a*, a light guide section 38*b* including a reflector, and an irradiation section 38*c*. The light guide 38 thus enables light entering through the incident section 38*a* to be guided via the light guide section 38*b* to the irradiation section 38*c*, which can then irradiate the light from the irradiation section 38*c*.

The photo sensor board unit 33 with the light receiving section 33*a* is fixed to the housing 30.

As shown in FIG. 15, with the cover 31 closed, the cam section 31*a* enters the cutout portion 30*b* defined in the housing 30, bringing the cam section 31*a* attached to the cover 31 into abutting contact with the light guide 38. The light guide 38 comes into abutting contact with the cam section 31*a* and is pushed by the cam section 31*a*. The light guide 38 thus moves pivotally while being biased. The pivotal movement of the light guide 38 allows the incident section 38*a* of the light guide 38 to be placed at the position opposite to the irradiation section 13 of the ink tank 10. The incident section 38*a* of the light guide 38 is thus placed at the position corresponding to the irradiation section 13 of the ink tank 10. Consequently, when the irradiation section 13 of the ink tank 10 delivers light, the light enters the light guide 38 through the incident section 38*a* thereof and is taken into the light guide 38. The light having entered the light guide 38 through the incident section 38*a* while the cover 31 is closed is guided through the light guide 38 and delivered toward the light receiving section 33*a* through the irradiation section 38*c*. In the present embodiment, an optical path 39 is formed which allows light to be guided from the irradiation section 38*c* in a direction C shown in FIG. 15.

With the printing apparatus configured as described above, the light receiving section 33*a* can receive light from the irradiation section 38*c* of the light guide 38 while the cover 31 is closed. Thus, when the ink tank 10 is placed at the position opposite to the irradiation section 38*a* of the light guide 38, the presence of the ink tank 10 at the predetermined detection position can be determined by the light receiving section 33*a* by detecting light emitted by the irradiation section 13 of the ink tank 10.

As shown in FIG. 16, when the cover 31 is opened, nothing holds the biased light guide 38, which is thus pivotally moved by the force of a biasing member (not shown in the drawings) that biases the light guide 38. The pivotal movement of the light guide 38 retracts a part of the light guide 38 including the incident section 38*a* from the opening 32 in the housing 30, increasing the area of the opening 32. This allows the user to easily access the ink tank 10. Thus, operations of installing and removing the ink tank 10 can be easily performed. Furthermore, when a print medium is jammed inside the printing apparatus, a process of dealing with the jammed print medium can be easily executed.

In the above-described embodiment, the configuration in which the light guide moves pivotally has been described. The present invention is not limited to this configuration. The light guide may be displaced by movement other than the pivotal movement. The light guide may be displaced by moving in a direction horizontal to the surface of the housing 30 in which the opening 32 is formed or moving in the direction intersecting the surface of the housing 30 in which the opening 32 is formed. The light guide 36 may move in the retracting direction from the opening 32 when the cover 31 is opened.

Sixth Embodiment

Now, a sixth embodiment of the present invention will be described. Components of the sixth embodiment similar to the corresponding components of the first to fifth embodiments are denoted by the same reference numerals and will thus not be described below. Only differences from the first to fifth embodiments will be described.

In the first to fifth embodiments, the printing apparatus has been described which allows determination of whether or not the ink tank is located at the predetermined position using the optical sensor. In contrast, in the sixth embodiment, a magnetic sensor is used as a sensor that allows determination of whether or not the ink tank is located at the predetermined position. In particular, in the sixth embodiment, whether or not the ink tank is located at the predetermined position is determined by providing a magnet in the ink tank 10 and providing a magnetic sensor such as a Hall element on the cover 31 or the housing 30.

Figure 17:
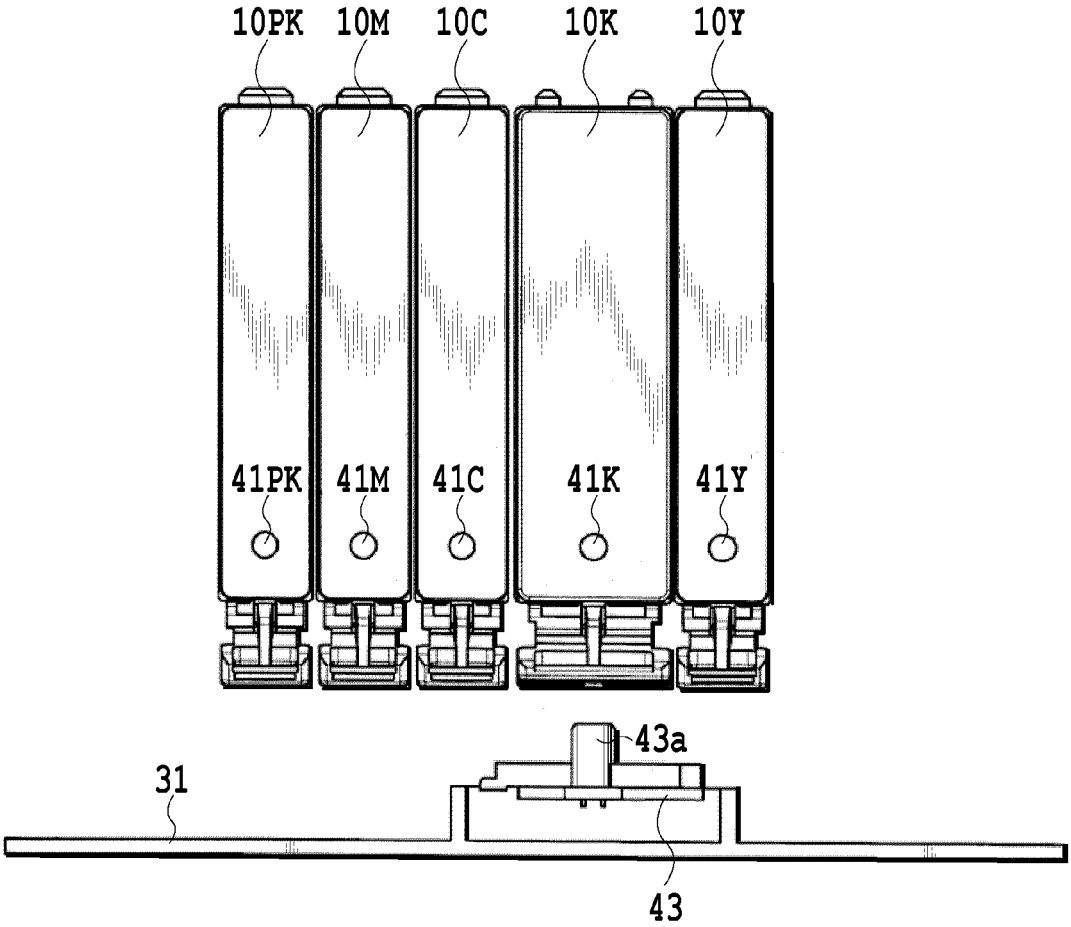
FIG. 17 is a plan view showing an ink tank and a Hall element in a printing apparatus according to a sixth embodiment of the present invention.

FIG. 17 is a plan view showing an important part of the printing apparatus according to the sixth embodiment. The ink tank 10 is provided with a plurality of magnets (magnetic force generating unit) 41, and each ink tank 10 is provided with the corresponding magnet 41. For the magnet 41, ink tanks 10K, 10PK, 10C, 10M, and 10Y are provided with magnets 41K, 41PK, 41C, 41M, and 41Y with different magnetic forces for the respective colors.

The cover 31 is provided with a magnetic-sensor board unit 43 including a Hall element (magnetic-force detection section) 43*a*. The Hall element 43*a* is placed at a position opposite to a magnet 120 in the ink tank 10 when the cover 31 is closed. The magnetic-sensor board unit 43 is connected to a control board (not shown in the drawings) via a cable (not shown in the drawings). Furthermore, a current in the Hall element 43*a* varies in accordance with the magnetic force, so that the position of the ink tank 10 can be detected by detecting the current. As described above, the printing apparatus may be configured to include the magnet 41, serving as a magnetic substance, and the Hall element 43*a*, serving as a magnetic-force detection unit for detecting the magnetic force. The printing apparatus may be configured to acquire information on whether the ink tank 10 is mounted on the carriage 20, based on the detected magnetic force.

The magnetic-sensor board unit 43 is attached to the cover 31. Thus, when the cover 31 is opened, the magnetic-sensor board unit 43 moves in conjunction with movement of the cover 31. At this time, the magnetic-sensor board unit 43 retracts from an area opposite to the magnet 41 in the ink tank 10 and moves in the retracting direction from the opening 32.

When the cover 31 is opened, the magnetic-sensor board unit 43 moves in the retracting direction from the opening 32. Consequently, opening of the cover 31 increases the area of the opening 32. This allows the user to easily access the ink tank 10. Thus, operations of installing and removing the ink tank 10 can be easily performed. Furthermore, when a print medium is jammed inside the printing apparatus, a process of dealing with the jammed print medium can be easily executed.

In the present embodiment, the printing apparatus is configured such that the magnetic-sensor board unit 43 is attached to the cover 31. However, the present invention is not limited to the above-described embodiment. As is the case with the light receiving section 33*a* in the third embodiment, the Hall element 43*a* of the magnetic-sensor board unit 43 may be attached to the cover 31 in a biased manner so that, when the cover 31 is closed, the Hall element 43*a* is placed, by the cam section, at a position where the magnetism can be detected. In that case, when the cover 31 is opened, the cam section moves in conjunction with movement of the cover, and the Hall element 43*a* is moved by the bias force in the retracting direction from the opening 32.

Furthermore, the positional relation between the magnet and the magnetic-sensor unit may be reversed. The magnetic-sensor unit may be attached to each ink tank 10, and the magnet may be attached to the cover 31 or housing 30 side. Furthermore, in the above-described embodiment, a magnetic sensor is installed to detect magnetism to determine whether or not the ink tank 10 is placed at the predetermined position. However, the present invention is not limited to this configuration.

Moreover, whether or not the ink tank 10 is located at the predetermined position may be determined by detecting an electromagnetic wave or an electric wave. In that case, the printing apparatus may be configured such that the magnet 41 is replaced with a noncontact IC tag and such that the magnetic-sensor board unit 43 is replaced with a reader unit. Thus, the printing apparatus may be configured to include generation unit for generating an electric wave or an electromagnetic wave and reception unit for receiving the electric wave or the electromagnetic wave generated by the generation unit. The printing apparatus may be configured to acquire information on whether or not the ink tank 10 is appropriately mounted on the carriage 20 based on the electric wave or electromagnetic wave received by the reception unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-034488 filed Feb. 25, 2014, which is hereby incorporated by reference wherein in its entirety.

What is claimed is:

1. A printing apparatus comprising:

a mounting unit on which a printing-agent housing container and printing unit are able to be mounted, the printing-agent housing container internally containing a printing agent, the printing unit performing printing using the printing agent housed in the printing-agent housing container, the mounting unit enabling a scan in a main scan direction;

a detection section configured to acquire information on whether or not the printing-agent housing container is mounted on the mounting unit;

a housing configured to internally store the mounting unit with the printing-agent housing container and the printing unit mounted thereon, the housing comprising an opening through which the printing-agent housing container mounted on the mounting unit is able to be opened to an exterior; and a cover configured to be able to cover the opening, wherein when the cover is closed the detection section is able to acquire information on whether or not the printing-agent housing container is mounted on the mounting unit, and when the cover is opened the detection section is able to move in a retracting direction from the opening;

the detection section is being movably attached to the housing in a biased manner with a cam member is attached to the cover, wherein when the cover is closed the detection section comes into abutting contact with the cam member to place the cam member at a position where the detection section is able to determine whether or not the printing-agent housing container is installed, and when the cover is opened the cam member is separated from the detection section and the detection section moves in the retracting direction from the opening in conjunction with movement of its cover.

2. The printing apparatus according to claim 1, wherein the opening is formed above a sheet discharge section into which a printed print medium is discharged, and the detection section is attached to the cover.

3. The printing apparatus according to claim 2, wherein the detection section is attached to an inner position on the cover.

4. The printing apparatus according to claim 1, wherein the detection section is attached to the housing in a biased manner so as to be able to move pivotally, and when the cover is opened, the cam member is separated from the detection section, and the detection section moves pivotally to move in the retracting direction from the opening.

5. A printing apparatus comprising:

a mounting unit on which a printing-agent housing container and printing unit are able to be mounted, the printing-agent housing container internally containing a printing agent, the printing unit performing printing using the printing agent housed in the printing-agent housing container, the mounting unit enabling a scan in a main scan direction;

a detection section configured to acquire information on whether or not the printing-agent housing container is mounted on the mounting unit;

a housing configured to internally store the mounting unit with the printing-agent housing container and the printing unit mounted thereon, the housing comprising an opening through which the printing-agent housing container mounted on the mounting unit is able to be opened to an exterior; and a cover configured to be able to cover the opening, wherein when the cover is closed the detection section is able to acquire information on whether or not the printing-agent housing container is mounted on the mounting unit, and when the cover is opened the detection section is able to move in a retracting direction from the opening, wherein the detection section comprises a magnetic-force generating unit for generating a magnetic force and a magnetic-force detection unit for detecting a magnetic force, and acquires information on whether or not the printing-agent housing container is mounted on the mounting unit based on the magnetic force detected by the magnetic-force detection unit.

6. A printing apparatus comprising:

a mounting unit on which a printing-agent housing container and printing unit are able to be mounted, the printing-agent housing container internally containing a printing agent, the printing unit performing printing using the printing agent housed in the printing-agent housing container, the mounting unit enabling a scan in a main scan direction;

a detection section configured to acquire information on whether or not the printing-agent housing container is mounted on the mounting unit;

a housing configured to internally store the mounting unit with the printing-agent housing container and the printing unit mounted thereon, the housing comprising an opening through which the printing-agent housing container mounted on the mounting unit is able to be opened to an exterior; and a cover configured to be able to cover the opening, wherein when the cover is closed the detection section is able to acquire information on whether or not the printing-agent housing container is mounted on the mounting unit, and when the cover is opened the detection section is able to move in a retracting direction from the opening, wherein the detection section comprises a generation unit for generating an electric wave or an electromagnetic wave and a reception unit for receiving the electric wave or electromagnetic wave emitted by the generation unit, and acquires information on whether or not the printing-agent housing container is mounted on the mounting unit based on the electric wave or an electromagnetic wave received by the reception unit.

7. A printing apparatus comprising:

a mounting unit on which a printing-agent housing container and printing unit are able to be mounted, the printing-agent housing container internally containing a printing agent, the printing unit performing printing using the printing agent housed in the printing-agent housing container, the mounting unit enabling a scan in a main scan direction;

a detection section configured to acquire information on whether or not the printing-agent housing container is mounted on the mounting unit;

a housing configured to internally store the mounting unit with the printing-agent housing container and the printing unit mounted thereon, the housing comprising an opening through which the printing-agent housing container mounted on the mounting unit is able to be opened to an exterior;

a cover configured to be able to cover the opening, wherein when the cover is closed the detection section is able to acquire information on whether or not the printing-agent housing container is mounted on the mounting unit, and when the cover is opened the detection section is able to move in a retracting direction from the opening the detection unit comprising a light emitting unit and a light receiving unit, wherein one of the light emitting unit and the light receiving unit is attached to the printing-agent housing container or the mounting unit, and the other of the light emitting and receiving unit is attached to the housing or the cover.

8. A printing apparatus comprising:

a mounting unit on which a printing-agent housing container and printing unit are able to be mounted, the printing-agent housing container internally containing a printing agent, the printing unit performing printing using the printing agent housed in the printing-agent housing container, the mounting unit enabling a scan in a main scan direction;

a detection section configured to acquire information on whether or not the printing-agent housing container is mounted on the mounting unit;

a housing configured to internally store the mounting unit with the printing-agent housing container and the printing unit mounted thereon, the housing comprising an opening through which the printing-agent housing container mounted on the mounting unit is able to be opened to an exterior;

a cover configured to be able to cover the opening, wherein when the cover is closed the detection section is able to acquire information on whether or not the printing-agent housing container is mounted on the mounting unit, and when the cover is opened the detection section is able to move in a retracting direction from the opening, wherein the detection unit comprises a light emitting unit and a light receiving unit; and the light receiving unit comprises a light guide through which light emitted by the light emitting unit passes and a light receiving element that receives light having passed through the light guide and enables detection of the light reception, wherein when the cover is opened, the light guide is able to move in the retracting direction from the opening.

9. A printing apparatus comprising:

a mounting unit on which a printing-agent housing container and printing unit are able to be mounted, the printing-agent housing container internally containing a printing agent, the printing unit performing printing using the printing agent housed in the printing-agent housing container, the mounting unit enabling a scan in a main scan direction;

a detection section configured to acquire information on whether or not the printing-agent housing container is mounted on the mounting unit;

a housing configured to internally store the mounting unit with the printing-agent housing container and the printing unit mounted thereon, the housing comprising an opening through which the printing-agent housing container mounted on the mounting unit is able to be opened to an exterior;

a cover configured to be able to cover the opening, wherein when the cover is closed the detection section is able to acquire information on whether or not the printing-agent housing container is mounted on the mounting unit, and when the cover is opened the detection section is able to move in a retracting direction from the opening a light emission detection unit for enabling detection of light emission when the light emitting unit emits light; and a position detection unit for determining whether or not the printing-agent housing container is located at a predetermined position along the main scan direction, wherein the detection unit comprises light emitting unit and light receiving unit, and an open/close status of the cover is determined based on a presence or absence of light reception by the light receiving unit, a detection result from the light emission detection unit and a detection result from the position detection unit.

* * * * *